US007849843B2

(12) United States Patent
Kojima et al.

(10) Patent No.: US 7,849,843 B2
(45) Date of Patent: Dec. 14, 2010

(54) IGNITION COIL

(75) Inventors: Masami Kojima, Chiryu (JP); Takashi Tauchi, Nagoya (JP); Takeshi Morimoto, Tajimi (JP); Atsushi Iwami, Kariya (JP); Yoshitaka Satoh, Toyohashi (JP); Shuichi Matsubayashi, Tsurugashima (JP); Ikuo Hirayama, Tsurugashima (JP)

(73) Assignees: Denso Corporation, Kariya (JP); Toyo Denso Kabushiki Kaisha, Tokyo (JP)

( * ) Notice: Subject to any disclaimer, the term of this patent is extended or adjusted under 35 U.S.C. 154(b) by 182 days.

(21) Appl. No.: 12/060,456

(22) Filed: Apr. 1, 2008

(65) Prior Publication Data

US 2009/0194084 A1 Aug. 6, 2009

(30) Foreign Application Priority Data

Apr. 27, 2007 (JP) ..... 2007-117830
Apr. 27, 2007 (JP) ..... 2007-117833
Apr. 27, 2007 (JP) ..... 2007-117834

(51) Int. Cl.
*F02P 3/02* (2006.01)

(52) U.S. Cl. ..... 123/635; 123/647; 336/65

(58) Field of Classification Search ..... 123/634, 123/635, 647; 336/90, 65; 439/125, 127
See application file for complete search history.

(56) References Cited

U.S. PATENT DOCUMENTS 4,082,980 A * 4/1978 Yoshikawa et al. ..... 315/59
5,003,958 A * 4/1991 Yoneyama et al. ..... 123/635
5,026,294 A 6/1991 Hisatomi et al.
5,144,935 A * 9/1992 Taruya et al. ..... 123/633
5,241,941 A * 9/1993 Hancock et al. ..... 123/634
5,307,785 A * 5/1994 Yoshikawa ..... 123/635
5,649,830 A * 7/1997 Ellsom et al. ..... 439/128
5,806,505 A 9/1998 Herbert
5,927,259 A * 7/1999 Ando et al. ..... 123/634
6,189,522 B1 2/2001 Moriya
6,860,256 B2 * 3/2005 Nakamura et al. ..... 123/621
7,148,780 B2 * 12/2006 Skinner et al. ..... 336/90
7,310,037 B2 * 12/2007 Skinner et al. ..... 336/90
7,332,991 B2 * 2/2008 Skinner et al. ..... 336/90
2004/0069288 A1 * 4/2004 Shimada et al. ..... 123/635

FOREIGN PATENT DOCUMENTS

JP 06-251964 9/1994

(Continued)

*Primary Examiner*—Stephen K Cronin
*Assistant Examiner*—Anthony L Bacon
(74) *Attorney, Agent, or Firm*—Nixon & Vanderhye, PC

(57) ABSTRACT

An ignition coil is equipped with a sparkplug of an engine. The ignition coil includes a coil portion, a tower portion, and a plug cap. The coil portion includes a coil case accommodating a primary and secondary coils being coaxial with each other. The coil portion has an end connected with the plug cap via the tower portion. The plug cap is press-fitted with the sparkplug. The coil case has an outer periphery from which a flange portion projects radially outward in a flange-projecting direction. The tower cylinder portion has a tower axis substantially in parallel with a coil axis of the primary and secondary coils. The tower axis is offset from the coil axis in a tower-offset direction. The tower-offset direction is substantially the same as the flange-projecting direction.

20 Claims, 24 Drawing Sheets

FOREIGN PATENT DOCUMENTS

| | | |
|---|---|---|
| JP | 10-220331 | 8/1998 |
| JP | 11-186077 | 7/1999 |
| JP | 2001-012337 | 1/2001 |
| JP | 2002-031025 | 1/2002 |
| JP | 2004-169619 | 6/2004 |

* cited by examiner

IGNITION COIL

CROSS REFERENCE TO RELATED APPLICATIONS

This application is based on and incorporates herein by reference Japanese Patent Applications No. 2007-117830 filed on Apr. 27, 2007, No. 2007-117834 filed on Apr. 27, 2007, and No. 2007-117833 filed on Apr. 27, 2007.

FIELD OF THE INVENTION

The present invention relates to an ignition coil.

BACKGROUND OF THE INVENTION

In general, an ignition coil for an internal combustion engine such as a vehicular engine includes a coil portion having a coil case accommodating a primary coil and a secondary coil. The coil portion has one axial end provided with a plug mount portion, which is equipped with an insulator portion of a sparkplug. The coil portion and the plug mount portion are connected and located on the same axis. Such an ignition coil is mounted to a cylinder head cover of an engine. Here, various constraints are subjected to a mount space, in which the ignition coil is mounted to the cylinder head cover. In a structure where such a plug mount portion of an ignition coil is equipped to a sparkplug attached to the cylinder head, a coil portion of the ignition coil needs to be located in the limited space in a cylinder head cover. In this case, when the ignition coil includes the coil portion and the plug mount portion located on the same axis, the outer circumferential periphery of the coil portion and the cylinder head cover therebetween define a reduced clearance. Consequently, the outer circumferential periphery of the coil portion may interfere with the cylinder head cover due to vibration of the engine.

For example, U.S. Pat. No. 5,026,294 (JP-U-2-115969) discloses an ignition coil, in which an axis of a plug socket (plug mount portion) is offset from an axis of a coil portion. Alternatively, for example, JP-A-10-220331 discloses an ignition coil having an axis portion provided with a socket portion, which is to be mounted to an igniter plug. The socket portion is formed of elastic resin and bendable with respect to the axis portion. In the present structure, the igniter plug is inclined relative to an axis of the cylinder of the engine. A socket portion of the ignition coil is configured to bend along the axis of the igniter plug when the socket portion is mounted to the igniter plug along a direction in parallel with the axis of the cylinder. In the present structure, a bracket of the ignition coil can be provided perpendicularly to the axis of the cylinder, whereby a shape of the bracket can be restricted from being complicated. However, both U.S. Pat. No. 5,026,294 and JP-A-10-220331 do not show a structure configured to appropriately secure a clearance between the coil portion and the cylinder head cover.

An ignition coil for an engine includes a primary coil and a secondary coil. The primary coil energizes in response to an instruction from an electronic control unit (ECU). The secondary coil generates high voltage (secondary voltage) for generating a spark in response to a change in magnetic flux produced when the energization in the primary coil is terminated. In a structure of a dual ignition system (two-point ignition system) in which mixture gas is ignited at two locations in a combustion chamber of each cylinder, two plugholes are provided to a cylinder head for each cylinder. In this dual ignition system, an ignition coil is mounted to each of the two the plugholes. For example, according to an igniter for an internal combustion engine disclosed in U.S. Pat. No. 6,189,522 B1 (JP-A-11-230017), sparkplugs are electrically connected respectively with one winding end of a secondary coil and an other winding end of the secondary coil. In the present structure, when energization of a primary coil is terminated, magnetic flux changes to simultaneously generate sparks between electrodes in each of two sparkplugs. In an ignition device of JP-A-2001-12337, for example, two secondary windings (secondary coils) are integrated with one primary winding (primary coil) to apply voltage, which is opposite from each other in polarity, to two electrodes. However, a space mounted with an ignition coil is limited in each cylinder. Therefore, in a two-point ignition system in which two ignition coils are mounted to each cylinder of the engine, a distance between two plugholes in a cylinder head needs to be increased. In particular, a distance between plugholes is significantly small in an engine with a small boa diameter of a piston. Consequently, two ignition coils are hard to be mounted to each cylinder.

An ignition coil for an engine includes a primary coil and a secondary coil. The primary coil energizes in response to an instruction from an electronic control unit (ECU). The secondary coil generates high voltage for generating a spark in response to induced electromotive force produced when the energization in the primary coil is terminated. A center core formed of a soft magnetic material is provided on the radially inner side of both the primary coil and the secondary coil. An outer core formed of a soft magnetic material is provided on the radially outer side of both the primary coil and the secondary coil. The cores construct a magnetic circuit for conducting magnetic flux generated by the primary coil. For example, according to an ignition coil of JP-A-2002-31025, an outer core and a center core configure a magnetic circuit for conducting magnetic flux, which is generated by a primary coil. The outer core defines a closed magnetic path. The center core passes though the inside of the outer ring core. One end of a center core and an inner circumferential periphery of the outer ring core, which is opposed to the one end of the center core, therebetween define a core gap. The core gap is provided with a piece of a permanent magnet. In the present structure, change in magnetic flux in each iron core can be enhanced at the time of termination of energizing of the primary coil, whereby an output of the ignition coil can be enhanced. In the ignition coil of JP-A-2004-169619, for example, multiple silicon steel plates are stacked to construct an E-shaped iron core and an I-shaped iron core. The E-shaped iron core and the I-shaped iron core are used to construct a magnetic circuit defining a closed magnetic path. However, in each of JP-A-2002-31025 and JP-A-2004-169619, a suitable structure of the closed magnetic path core being in the square annulus shape is not disclosed.

SUMMARY OF THE INVENTION

In view of the foregoing and other problems, it is an object of the present invention to produce an ignition coil capable of securing a clearance between a coil portion of the ignition coil and a cylinder head cover of an engine when the ignition coil is mounted to a limited accommodation space around the cylinder head cover. It is another object of the present invention to produce an ignition coil having a dual-ignition structure and configured to be mounted to two plug holes therebetween having a limited distance. It is another object of the present invention to produce an ignition coil having primary and secondary coils being restricted from increasing in size.

According to one aspect of the present invention, an ignition coil configured to be equipped with a first sparkplug of an engine, the ignition coil comprises a coil portion including a coil case accommodating a primary coil and a secondary coil, which are coaxial with each other and have a coil axis. The ignition coil further comprises a plug mount portion including a tower portion, which is formed from resin, and a plug cap, which is formed of rubber. The tower portion includes a coupled portion connected with an end of the coil portion. The tower portion further includes a tower cylinder portion projected from the coupled portion and equipped with the plug cap. The plug cap is configured to be press-fitted with the first sparkplug. The coil case has an outer periphery from which a flange portion projects radially outward in a flange-projecting direction. The flange portion is configured to be fixed to the engine by using a fixing member. The tower cylinder portion has a tower axis, which is substantially in parallel with the coil axis. The tower axis is offset from the coil axis in a tower-offset direction. The tower-offset direction is substantially the same as the flange-projecting direction.

According to another aspect of the present invention, an ignition coil configured to be equipped with a first and second sparkplugs respectively attached to a first and second plugholes for conducting ignition at a plurality of locations in a cylinder of an engine, the ignition coil comprises a coil portion having a coil case accommodating primary and secondary coils and a soft magnetism core, the soft magnetism core being configured to conduct magnetic flux through a path radially inside of both the primary and secondary coils. The secondary coil includes first and second secondary coils respectively located on one axial end side and an other axial end side and formed by winding a common wire respectively in first and second winding directions being opposite to each other. The second secondary coil is electrically connected with a conducting cable, which extends from the other axial end side of the coil portion and has a tip end provided with a second plug mount portion via which the second secondary coil is configured to be electrically connected with the second sparkplug. The coil portion has a first plug mount portion on the one axial end side, the first plug mount portion being configured to electrically connect the first secondary coil with the first sparkplug. The coil portion is configured to be elected upright outside the first plughole in a state where the first plug mount portion is equipped with an insulator portion of the first sparkplug in the first plughole.

According to another aspect of the present invention, an ignition coil comprises a coil portion including a primary and secondary coils being coaxial with each other. The ignition coil further comprises a closed magnetic path core substantially in an annulus shape to form a path configured to conduct magnetic flux radially inside and outside of both the primary and secondary coils and both axial end sides of the primary and secondary coils. The closed magnetic path core includes a core center portion and a core outer portion respectively located radially inside and outside of both the primary and secondary coils, the core outer portion being located relative to the core center portion in a first direction. The closed magnetic path core is constructed by connecting first and second core members via one connecting portion, which defines a core gap provided with a permanent magnet, and an other connecting portion, which defines a joint portion in which end surfaces of the first and second core members are in contact with each other. The first and second core members are constructed of a plurality of electromagnetic plates, which are formed from a soft magnetism material and stacked in a second direction, which is perpendicular to the first direction. The plurality of electromagnetic plates are different from each other in width, whereby the core center portion is substantially in a circular shape in cross section.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 2:
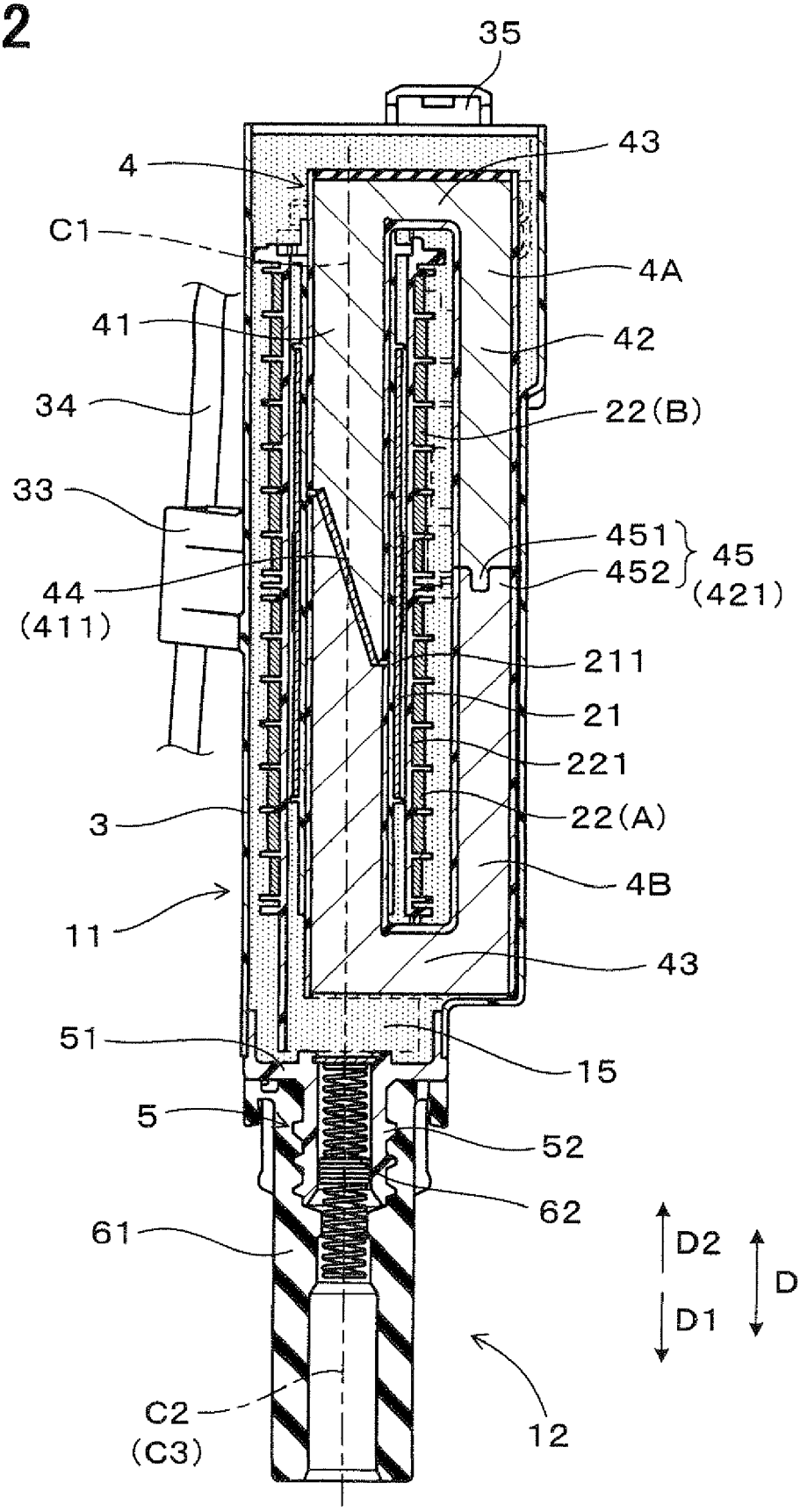
FIG. 2 is a longitudinal sectional view showing the ignition coil when being viewed from a second direction, the second direction being perpendicular to the first direction in FIG. 1.

As follows, an ignition coil 1 is described with reference to drawings. In this embodiment, as shown in FIG. 2, the ignition coil 1 includes a coil portion 11 and a plug mount portion 12. The coil portion 11 includes a coil case 3 accommodating a primary coil 21 and a secondary coil 22, which are coaxial with each other. The coil case 3 is formed of resin. One of the primary coil 21 and the secondary coil 22 is located radially outside of the other of the primary coil 21 and the secondary coil 22. The plug mount portion 12 is provided to an end of the coil portion 11 on a high voltage side D1. The plug mount portion 12 is mounted with an insulator portion 81 of a sparkplug 8. The ignition coil 1 is constructed such that the plug mount portion 12 is located in a plughole 911 of a cylinder head 91 of an engine 100 and the coil portion 11 is located outside the plughole 911.

The coil case 3 has an outer circumferential periphery provided with a flange portion 31, which projects radially outward. A cylinder head cover 92 is attached to the cylinder head 91, and the flange portion 31 is fixed to the cylinder head cover 92 with a bolt 312 as a fixing member. The plug mount portion 12 includes a tower portion 5, a conductive metal fitting 7, a plug cap 61, and a coil spring 62. The tower portion 5 is formed of resin, and connected with the coil portion 11. The metal fitting 7 is electrically connected with a high-voltage end of a winding of the secondary coil 22. The plug cap 61 is formed of rubber, and press-fitted with the insulator portion 81 of the sparkplug 8. The insulator portion 81 has a tip end provided with a terminal portion 82. The coil spring 62 electrically conducts the metal fitting 7 with the terminal portion 82.

Figure 1:
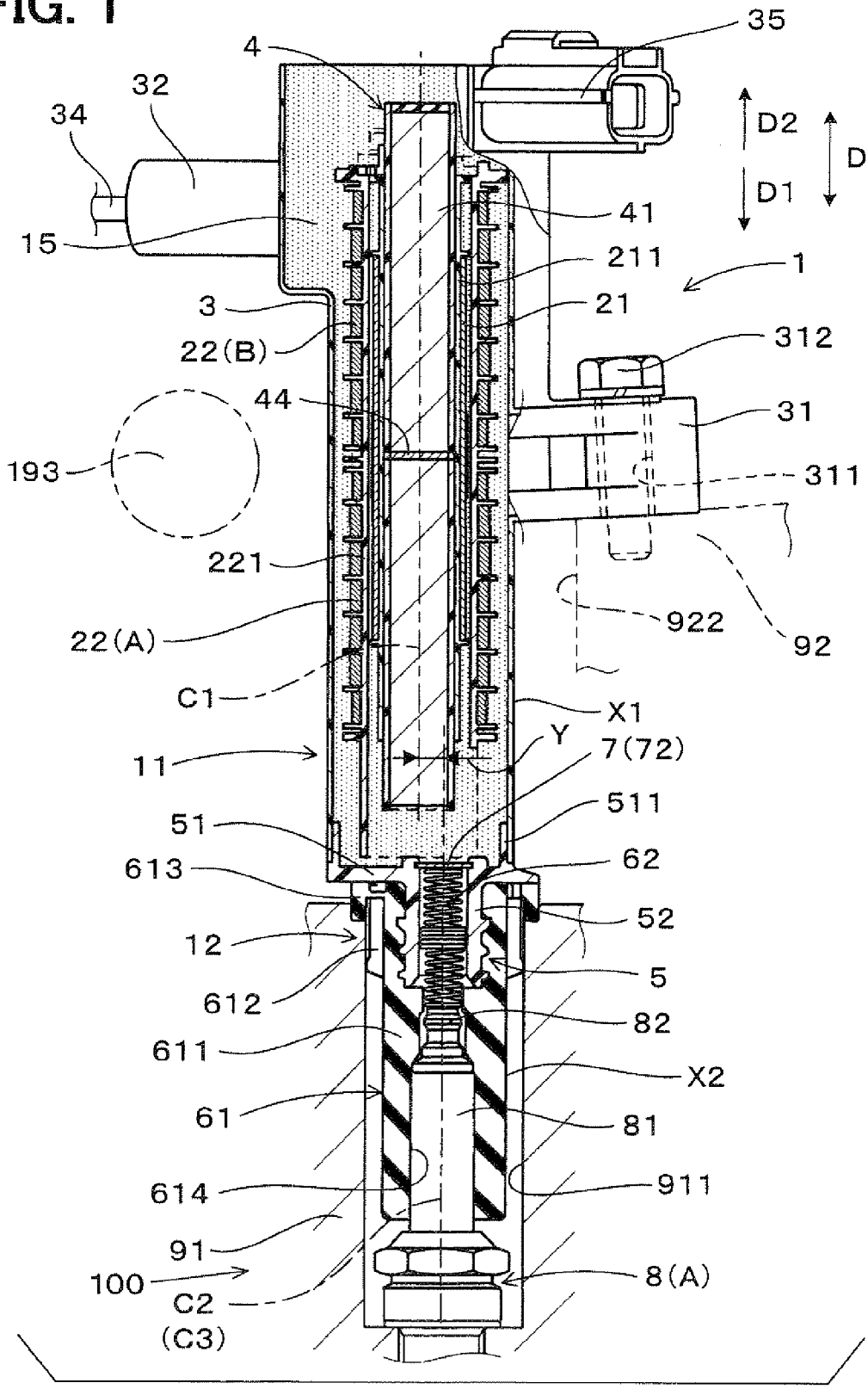
FIG. 1 is a longitudinal sectional view showing an ignition coil according to a first embodiment, the ignition coil being viewed from a first direction.

Referring to FIG. 1, the tower portion 5 includes a coupled portion 51 and a tower cylinder portion 52. The coupled portion 51 is connected with the coil portion 11. The tower cylinder portion 52 is in the shape of a cylinder and protruded from the coupled portion 51. The tower cylinder portion 52 is mounted with the plug cap 61. The tower cylinder portion 52 has a tower axis C2, which is in parallel with a coil axis C1 of both the primary coil 21 and the secondary coil 22. The tower axis C2 is offset from the coil axis C1 in a direction, substantially along which the flange portion 31 radially extends.

As follows, the ignition coil 1 is described with reference to FIGS. 1 to 9. The ignition coil 1 according to the present embodiment is provided to, for example, a dual ignition system (two-point ignition system) in which mixture gas is ignited at two locations in a combustion chamber of each cylinder of the engine 100. The ignition coil 1 according to the present embodiment is provided to, for example, each cylinder of the cylinder head 91 of the engine 100. A combustion chamber of each cylinder 91 of the engine 100 has an upper portion having a first plughole 911 and a second plughole. The first plughole 911 is attached with a first sparkplug 8A. The second plughole is attached with a second sparkplug 8B.

Figure 8:
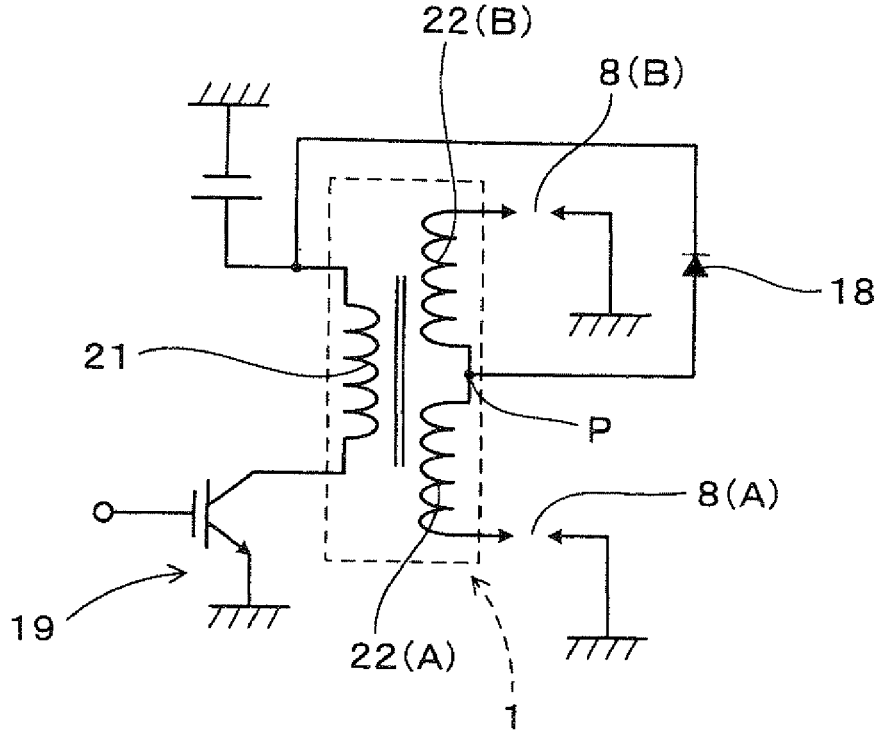
FIG. 8 is a schematic view showing an electric circuit for the ignition coil, according to the first embodiment.

As shown in FIGS. 1, 8, the primary coil 21 according to the present embodiment includes a primary spool 211, which is a cylindrical resin member, and a primary wire, which is applied with an electrically insulative coating. The primary coil 21 is constructed by winding the primary wire around the outer circumferential periphery of the primary spool 211 by a primary winding number. In the present embodiment, the ignition coil 1 includes two secondary coils 22, which are connected in series with respect to an axial direction D. Specifically, in the present embodiment, the secondary coil 22 includes a first secondary coil 22A and a second secondary coil 22B. The first secondary coil 22A is located on an outer periphery of a secondary spool 221 on one axial end side D1. The secondary spool 221 is formed of resin to be in the ring-shaped in cross section. The first secondary coil 22A is constructed by winding a secondary electric wire, which is applied with an electrically insulative coating, from the one axial end side D1 toward the other axial end side D2 in one winding direction The second secondary coil 22B is located on an outer periphery of the secondary spool 221 on the other axial end side D2. The second secondary coil 22B is constructed by winding a secondary electric wire, which extends from one end of the first secondary coil 22A, and the secondary electric wire is wound from the one axial end side D1 toward the other axial end side D2 in a winding direction opposite to the one winding direction. The present two secondary coils 22 are wound to be in a predetermined winding state. The two secondary coils 22 can be wound from either one of the one axial end side D1 or the other axial end side D2.

Figure 9:
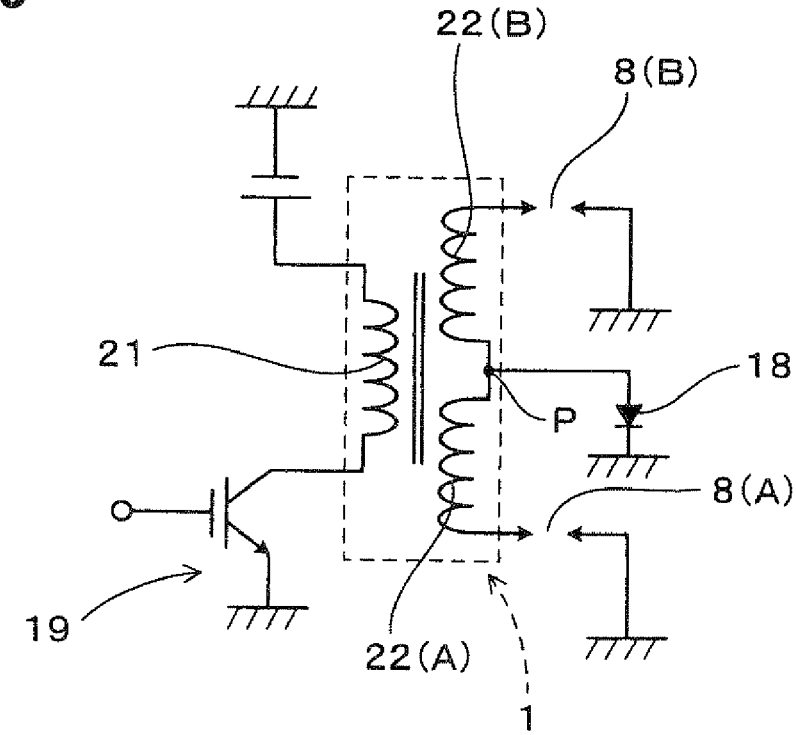
FIG. 9 is a schematic view showing another electric circuit for the ignition coil, according to the first embodiment.

As shown in FIG. 8, the first secondary coil 22A is electrically connected with the first sparkplug 8A, and the second secondary coil 22B is electrically connected with the second sparkplug 8B. The first secondary coil 22A and the second secondary coil 22B therebetween have a halfway point P to which an anode terminal of a diode 18 is electrically connected. The diode 18 has a cathode terminal, which is connected to a positive pole end of the primary coil 21. The primary coil 21 is connected with the battery via the positive pole end. Alternatively, as shown in FIG. 9, the cathode terminal of the diode 18 may be connected with a ground.

Referring to FIG. 1, in the present embodiment, the plug mount portion 12 as a first plug mount portion 12 is equipped to the first sparkplug 8A. The first sparkplug 8A is attached to a bottom of the first plughole 911. In the present embodiment, a conducting cable 34 extends from the end of the coil portion 11 on the other axial end side D2. The conducting cable 34 is electrically connected with the second secondary coil 22B. As unillustrated, the conducting cable 34 has a tip end provided with a second plug mount portion, which is equipped with the second sparkplug 8B. The second plug mount portion includes a conductive metal fitting, a plug cap, and an engaging metal fitting. The conductive metal fitting is electrically connected with the conducting cable 34. The plug cap is formed of rubber, and press-fitted with the insulator portion of the second sparkplug 8B. The engaging metal fitting electrically conducts the conductive metal fitting with the terminal portion of the second sparkplug 8B.

As shown in FIGS. 1, 2, the coil case 3 accommodates a closed magnetic path core 4. The primary coil 21 is energized via ends on both the axial end sides D1, D2 to generate a magnetic flux by utilizing an inner circumference and an outer circumference of the primary coil 21 and the secondary coil 22, so that the closed magnetic path core 4 therethrough conducts the magnetic flux. The present closed magnetic path core 4 is constructed of a core center portion 41, a core outer portion 42, and a pair of core interconnecting portions 43 to be in the shape of a square annulus. The core center portion 41 is located on the radially inner side of the primary coil 21 and the secondary coil 22. The core outer portion 42 is located on the radially outer side of a part of the primary coil 21 and secondary coil 22. Each of the pair of core interconnecting portions 43 interconnects the core outer portion 42 with the core center portion 41 at both ends of each of the primary coil 21 and the secondary coil 22 on both the axial end sides D1, D2. The closed magnetic path core 4 is constructed by connecting two core members 4A, 4B from both ends of each of the primary coil 21 and the secondary coil 22 on both the axial end sides D1, D2. The two core members 4A, 4B are constructed by stacking multiple electromagnetic plates, each of which is made of a soft magnetism material, in a second direction. The second direction is perpendicular to a first direction, in which the core center portion 41 and the core outer portion 42 are arranged.

As shown in FIG. 2, the two core members 4A, 4B therebetween have connecting portions 411, 421. One of the connecting portions 411, 421 defines a core gap 44 provided with a permanent magnet. The other of the connecting portions 411, 421 defines a joint portion 45 via which the end surfaces of the two core members 4A, 4B are in contact with each other. In the present embodiment, the core gap 44 is located in the core center portion 41 in the state where the core gap 44 is inclined with respect to the axial direction D of the coil portion 11. In the present embodiment, a projected portion 451 is provided to one of the core members 4A, 4B, and a recessed portion 452 is provided to the other of the core members 4A, 4B. The projected portion 451 is fitted to the recessed portion 452 in the Joint portion 45.

Figure 3:
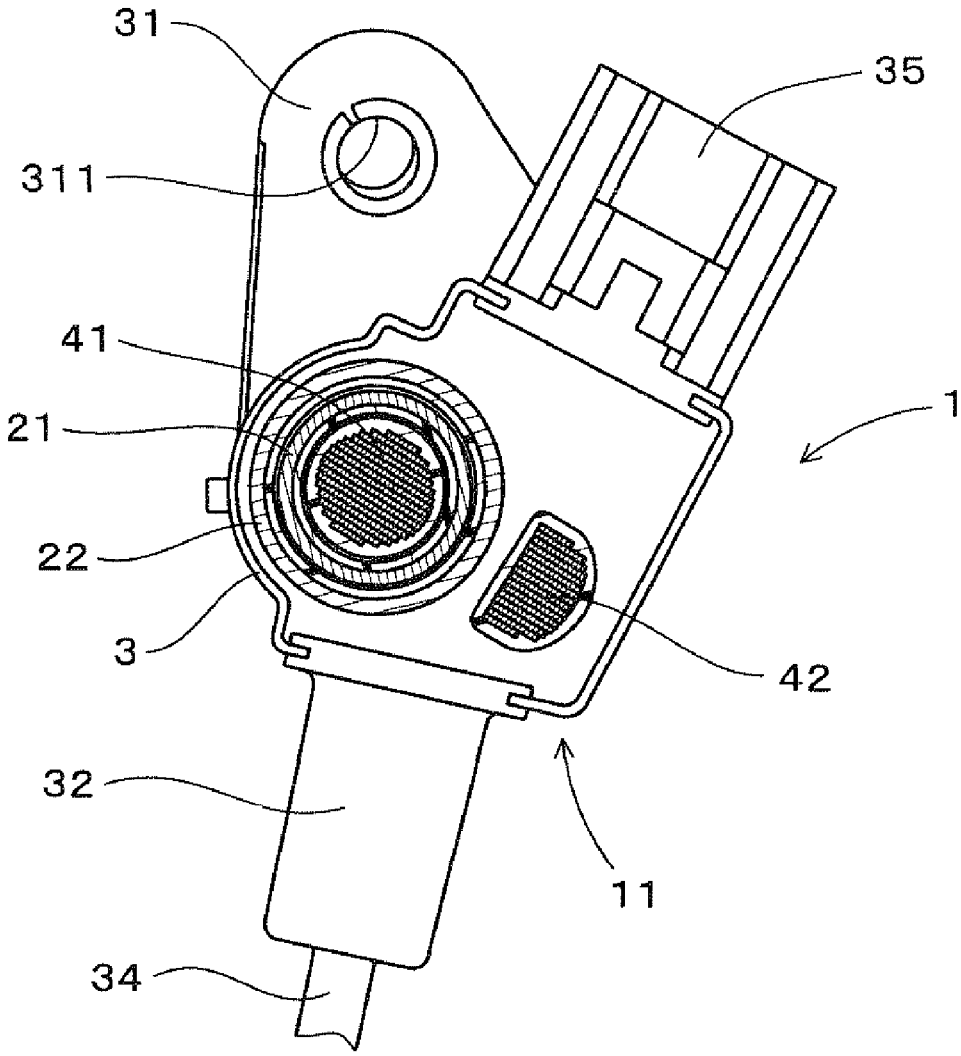
FIG. 3 is an axial sectional view showing the ignition coil according to the first embodiment.

Referring to FIGS. 1, 3, the outer circumferential periphery of the coil case 3 on the other axial end side D2 is provided with a connector portion 35, which projects radially outward from the end of the coil case 3 on the other axial end side D2. The connector portion 35 is provided with a conduction pin for conducting electricity to each winding end of the primary coil 21. A harness is pulled out from the connector portion 35. The primary coil 21 is connected with an igniter device via the harness. The igniter device is provided outside the ignition coil 1. As shown in FIG. 8, the igniter device (switching control circuit) 19 controls supplying of electricity to the primary coil 21 and termination of the electricity in response to a signal transmitted from an electronic control unit (ECU).

A cable drawing portion 32 is projected radially outward from the outer circumferential periphery of the end of the coil case 3 on the other axial end side D2. The conducting cable 34 is drawn from the cable drawing portion 32. An end of a high-voltage winding of the second secondary coil 22B on the other axial end side D2 is electrically connected with the conducting cable 34 via a drawing metal fitting provided to the cable drawing portion 32. Referring to FIGS. 1, 2, the coil portion 11, i.e., the coil case 3 has a clearance therein, and the clearance accommodates the primary coil 21, the secondary coil 22, the closed magnetic path core 4, and the like. The coupled portion 51 of the tower portion 5 and the coil case 3 therebetween define a gap, and the gap is filled with thermosetting insulating resin 15 such as epoxy resin.

Referring to FIGS. 1, 3, in the present embodiment, the flange portion 31 has an insertion hole 311. An axis portion of the bolt 312 is inserted through the insertion hole 311 and screwed to a screw hole provided in the cylinder head cover 92, so that the flange portion 31 is fixed to the cylinder head cover 92 via the bolt 312. The flange portion 31 is provided to the outer circumferential periphery of the coil case 3. The flange portion 31 is located in a position, which corresponds to an intermediate portion between the first secondary coil 22A and the second secondary coil 22B. The ignition coil 1 is fixed to the cylinder head cover 92 substantially at an intermediate position of the coil portion 11 with respect to the axial direction D. The coil portion 11 has an upper portion projected upward from the cylinder head cover 92.

Figure 4:
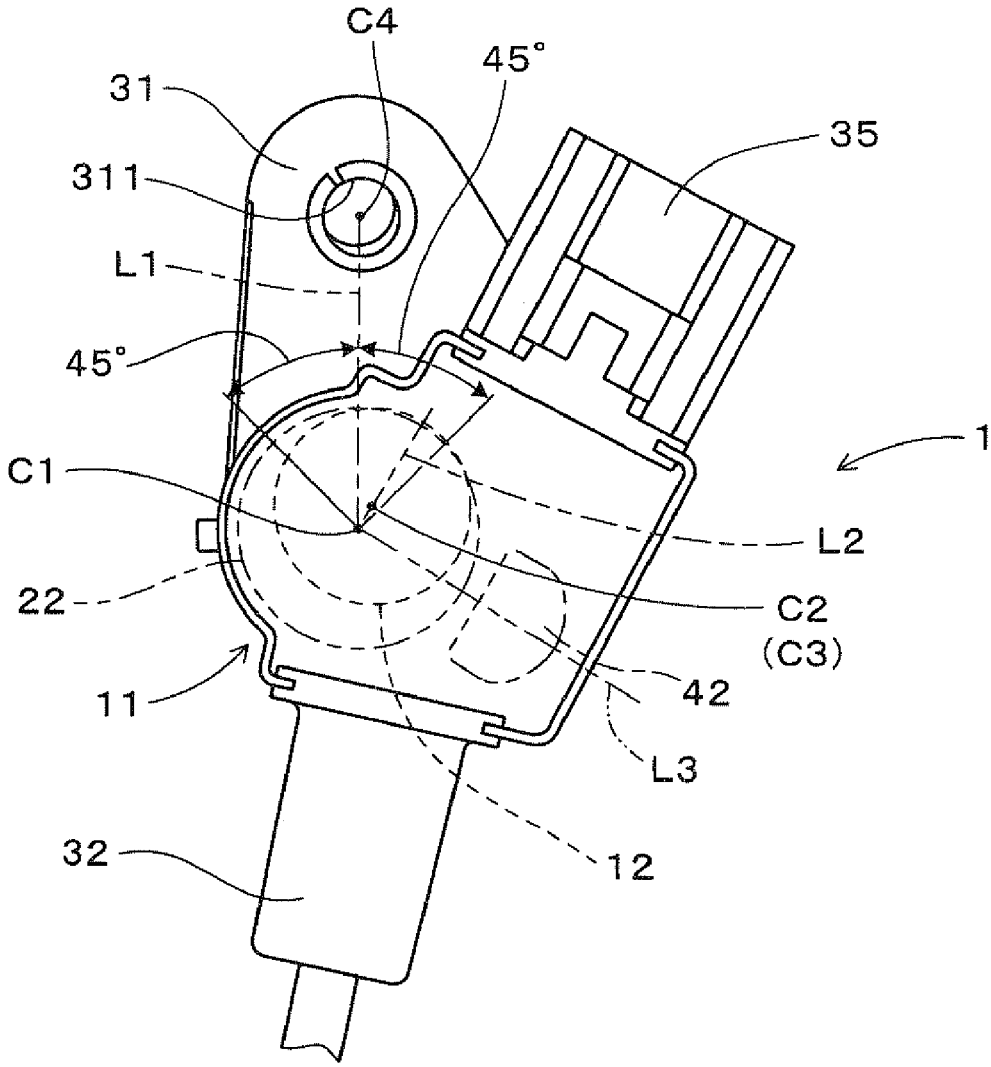
FIG. 4 is a view showing a tower portion, which is offset from a coil portion in the ignition coil, according to the first embodiment.
Figure 5:
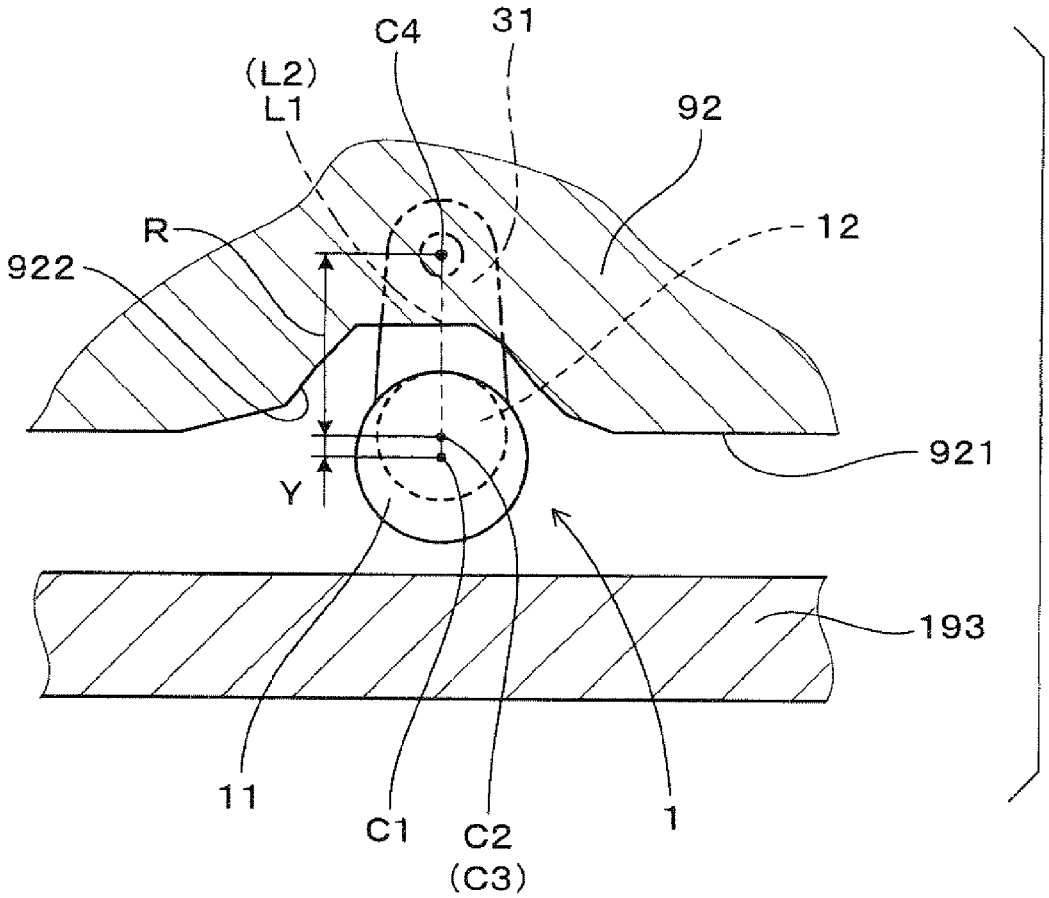
FIG. 5 is a schematic view showing an ignition coil fixed to a cylinder head cover of an engine, according to the first embodiment.

As shown in FIG. 4, in the present embodiment, the tower axis C2 is offset from the coil axis C1. Specifically, an imaginary line L1 extends from the coil axis C1 to a fixing axis C4 of the bolt 312 of the flange portion 31. The fixing axis C4 corresponds to the center of the insertion hole 311. An Imaginary line L2 extends from the coil axis C1 to the tower axis C2. The Imaginary line L2 is at an angle with respect to the imaginary line L1 on the right side in FIG. 4, and the angle is within a range of 45 degrees. The Imaginary line L2 is at an angle with respect to the imaginary line L1 on the left side in FIG. 4, and the angle is within the range of 45 degrees. As shown in FIG. 5, the tower axis C2 may be offset from the coil axis C1 such that the imaginary line L1 substantially coincides with the imaginary line L2. The imaginary line L1 extends from the coil axis C1 to the fixing axis C4 of the bolt 312 of the flange portion 31. The imaginary line L2 extends from the coil axis C1 to the tower axis C2.

In a state shown in FIG. 5, the ignition coil 1 is fixed to the cylinder head cover 92. The tower axis C2 is offset from the coil axis C1 with respect to the direction along which the flange portion 31 extends. The letter Y in FIG. 5 depicts a degree (offset degree) of the offset between the tower axis C2 and the coil axis C1. In the present embodiment, the offset degree Y is set to be 3.85 mm. The offset degree Y may be set in a range between 2 mm and 6 mm, for example. In FIG. 5, the cylinder head cover 92 is provided to the upper side of the cylinder head 91. The cylinder head cover 92 has an end 921 opposed to the coil portion 11 of the ignition coil 1. The cylinder head cover 92 has a notch 922 at the end 921 and the notch 922 receives the coil portion 11 of the ignition coil 1. Referring to FIGS. 1, 5, a fuel rail 193 is provided on the upper side of the cylinder head 91 for leading fuel therein. With respect to the fuel rail 193, the ignition coil 1 is located closer than the cylinder head cover 92.

In FIG. 5, the letter R indicates a distance from the tower axis C2 to the fixing axis C4 of the bolt 312 of the flange portion 31. In the structure of the offset shown in the FIG. 5, the distance R from the tower axis C2 to the fixing axis C4 of the bolt 312 in the flange portion 31 can be reduced to be less than the distance from the coil axis C1 to the fixing axis C4. In the present structure, a product of force exerted to the tower cylinder portion 52 and the distance from the tower axis C2 to the fixing axis C4 can be reduced. Thus, moment applied to the ignition coil 1 can be reduced, so that stress working on the flange portion 31 can be reduced. Referring to FIG. 4, the flange portion 31 extends in a direction different from a direction in which the core outer portion 42 is located with respect to the core center portion 41 of the closed magnetic path core 4. Specifically, an imaginary line L3 connects the center of the core outer portion 42 and the center of the core center portion 41, and the flange portion 31 extends in a direction different from a direction in which the imaginary line L3 extends. In the present structure, the direction, in which the flange portion 31 extends, can be suitably determined, so that the ignition coil 1 can be reduced in size. In particular, an occupation area of the ignition coil 1 with respect to a direction perpendicular to the axial direction D of the coil portion 11 can be reduced.

Referring to FIGS. 1, 2, in the present embodiment, the tower portion 5 is a separate component from the coil portion 11. In addition, the fitted portion 511, which is projected from the coupled portion 51 of the tower portion 5, is fitted into an inner periphery of the coil case 3 on the one axial end side D1, thereby being connected with the coil case 3. In the present embodiment, the plug cap 61 includes a cap body 611 and multiple latch projections 612. The cap body 611 has an outer circumferential periphery substantially in the shape of a circle in cross section. The latch projections 612 are projected radially outward from the outer circumferential periphery of the cap body 611. The latch projections 612 are circumferentially arranged on the cap body 611. The plug cap 61 is inserted to the first plughole 911 and latched via the latch projections 612. A sealing portion 613 is provided to the end of the plug cap 61 on the other axial end side D2. The sealing portion 613 closes an opening of the first plughole 911.

Figure 6:
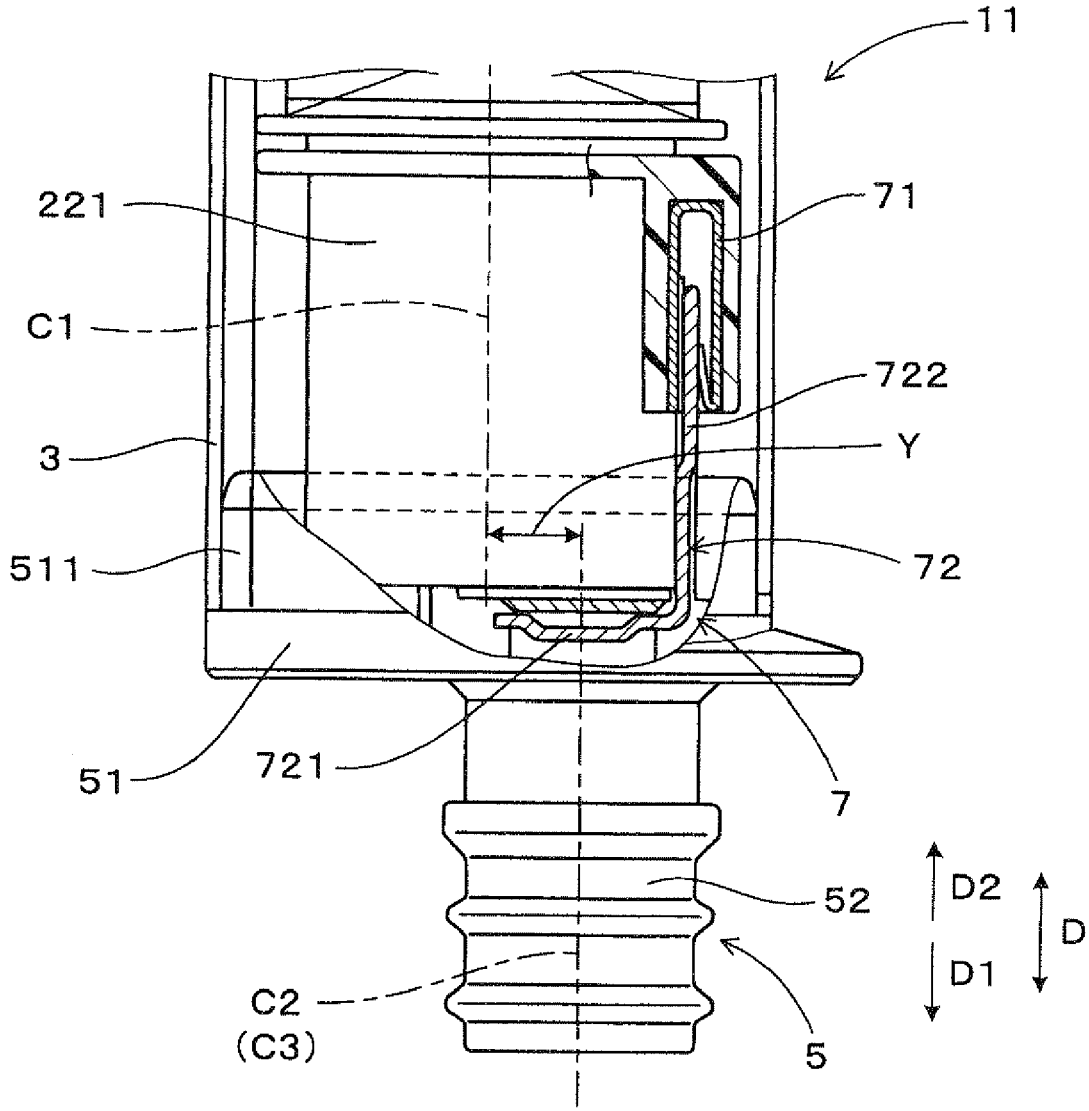
FIG. 6 is a schematic view showing the tower portion having a conductive metal fitting according to the first embodiment.

As shown in FIG. 6, in the present embodiment, the conductive metal fitting 7 includes a spool side metal fitting 71 and a tower side metal fitting 72. The spoof side metal fitting 71 is provided to the outer periphery of the secondary spool 221 on the one axial end side D1, and is electrically connected with the high-voltage end of the winding of the first secondary coil 22A. The tower side metal fitting 72 is provided to the coupled portion 51 of the tower portion 5 to electrically conduct the spool side metal fitting 71 with the coil spring 62. The spool side metal fitting 71 is offset from the coil axis C1 in a direction, which is substantially the same as the direction in which a plug axis C3 (tower axis C2) is offset from the coil axis C1. The tower side metal fitting 72 is constructed by continuously forming a spring contact portion 721 with a connecting terminal portion 722. The spring contact portion 721 is in contact with the coil spring 62. The connecting terminal portion 722 is provided to the outer periphery of the secondary spool 221 on the one axial end side D1. The connecting terminal portion 722 is electrically connected with the spool side metal fitting 71. In the present structure, both the spool side metal fitting 71 and the connecting terminal portion 722 are offset from the coil axis C1 in a direction, which is substantially the same as the direction in which the plug axis C3 is offset from the coil axis C1. Therefore, an electrically conduction path in the tower side metal fitting 72 can be reduced. In the present structure, electromagnetic noise emitted from the tower side metal fitting 72 can be reduced. In FIG. 6, both the tower axis C2 and the plug axis C3 are at a distance (offset degree) Y from the coil axis C1.

Referring to FIGS. 1, 2, in the present embodiment, the plug cap 61 is attached to the tower cylinder portion 52 of the tower portion 5 such that the plug cap 61 is in parallel with the tower cylinder portion 52. The insulator portion 81 of the sparkplug 8 is press-fitted to a press-fit opening 614 of the plug cap 61. The plug axis C3 of the press-fit opening 614 substantially coincides with the tower axis C2. The coil spring 62 is located to extend over the inside of the tower cylinder portion 52 and the inside of the plug cap 61. The coil spring 62 has a lower end with respect to the axial direction D, and the lower end is in contact with the terminal portion 82 of the sparkplug 8. The coil spring 62 has an upper end with respect to the axial direction D, and the upper end is in contact with the spring contact portion 721 of the conductive metal fitting 7. Thus, the high-voltage end of the winding of the first secondary coil 22A is electrically connected with the terminal portion 82 of the sparkplug 8.

In the present embodiment, the ignition coil 1 is capable of generating a spark between electrodes in each of the two sparkplugs 8A, 8B. Referring to FIG. 8, when the switching control circuit 19 supplies electricity to the primary coil 21 in response to an instruction transmitted from the ECU, the closed magnetic path core 4 generates a magnetic field to pass therethrough. Subsequently, when the electricity supply to the primary coil 21 is terminated, the primary coil 21 therein causes voltage by self-induction, and the two secondary coils 22 therein cause high-voltage induced electromotive force by mutual induction. Thus, a spark can be generated between the electrodes of the first sparkplug 8A, which is electrically connected with the first secondary coil 22A. Another spark can be also generated between the electrodes of the second sparkplug 8B, which is electrically connected with the second secondary coil 22B.

In the present embodiment, the ignition coil 1 has a specific structure to enable appropriately securing of a clearance between the plughole 911 and the cylinder head cover 92 when the coil portion 11 is attached outside the plughole 911 of the cylinder head 91. Thus, the coil portion 11 is attached to the cylinder head cover 92 with securing the clearance. Specifically, the outer circumferential periphery of the coil case 3 of the coil portion 11 is provided with the flange portion 31 via which the coil portion 11 is fixed to the cylinder head cover 92. The tower cylinder portion 52 of the tower portion 5 of the first plug mount portion 12 has the tower axis C2. The primary coil 21 and the secondary coil 22 of the coil portion 11 have the coil axis C1. The tower axis C2 is offset from the coil axis C1 in the direction, which is substantially the same as the direction (flange forming direction), in which the flange portion 31 is formed, i.e., extended, in a condition being substantially in parallel with each other. In addition, referring to FIG. 1, in the ignition coil 1 according to the present embodiment, the offset degree Y of the plug axis C3 relative to the coil axis C1 is determined to satisfy the following condition. Specifically, the offset degree Y is determined such that a position X2 of the outer circumferential periphery of the cap body 611 is substantially the same as a position X1 of the outer circumferential periphery of the coil case 3 with respect to the direction (offset direction), in which the plug axis C3 is offset from the coil axis C1. That is, the offset degree Y is determined such that the position X1 substantially coincides with the position X2 when being viewed along the offset direction.

Furthermore, the ignition coil 1 according to the present embodiment is mounted to the engine 100 in the following manner. Specifically, the plug cap 61 is attached to the tower cylinder portion 52. The plug cap 61 and the tower cylinder portion 52 are equipped with the first sparkplug 8A, which is attached to the bottom of the first plughole 911 of the cylinder head 91. Thereafter, the flange portion 31 is fixed to the cylinder head cover 92 using the bolt 312. In the present offset structure, even when the distance between the position of the end 921 of the cylinder head cover 92 and the position of the sparkplug 8 is restricted to be small on the plane, the clearance between the coil cases 3 of the coil portion 11 and the end 921 of the cylinder head cover 92 can be appropriately secured. That is, even when the distance between the position of the end 921, in particular the notch 922, and the position of the sparkplug 8 is restricted to be small with respect to the direction perpendicular to the axial direction D of the coil portion 11, the clearance can be appropriately secured. Therefore, even when the coil portion 11 receives vibration from the engine 100 and the like, the coil portion 11 can be restricted from interfering with the cylinder head cover 92.

Therefore, according to the ignition coil 1 in the present embodiment, even when an accommodation space for the ignition coil 1 is subjected with a constraint, the clearance between the coil portion 11 and the cylinder head cover 92 can be appropriately secured, whereby the coil portion 11 can be restricted from interfering with the cylinder head cover 92.

Figure 7:
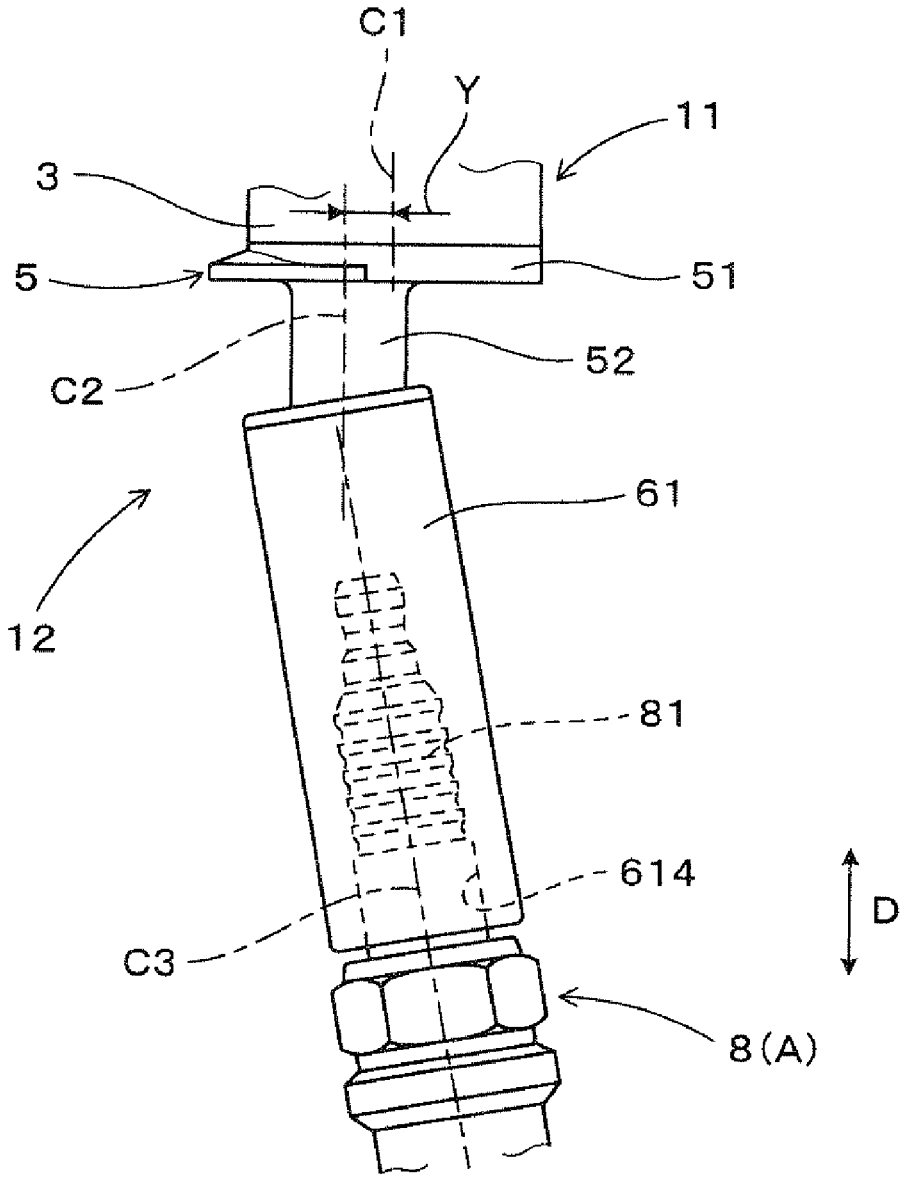
FIG. 7 is a schematic view showing the tower portion mounted with a plug cap in a condition where the tower portion is inclined relative to the plug cap.

As shown in FIG. 7, the plug cap 61 can be also equipped in the state where the plug cap 61 is inclined relative to the tower cylinder portion 52. The plug cap 61 has the press-fit opening 614 through which the insulator portion 81 of the first sparkplug 8A is press-fitted to the plug cap 61. In the plug cap 61, the plug axis C3 of the press-fit opening 614 can be inclined with respect to the coil axis C1 in, for example, an opposite direction to the flange forming direction in which the flange portion 31 is formed and extended. In this case, even when the mounting direction of the plug cap 61 relative to the first sparkplug 8A is inclined with respect to the axial direction D of the coil portion 11, the clearance between the coil case 3 of the coil portion 11 and the end 921, in particular the notch 922, of the cylinder head cover 92 can be appropriately secured by offsetting the tower axis C2 from the coil axis C1.

Second Embodiment

Figure 13:
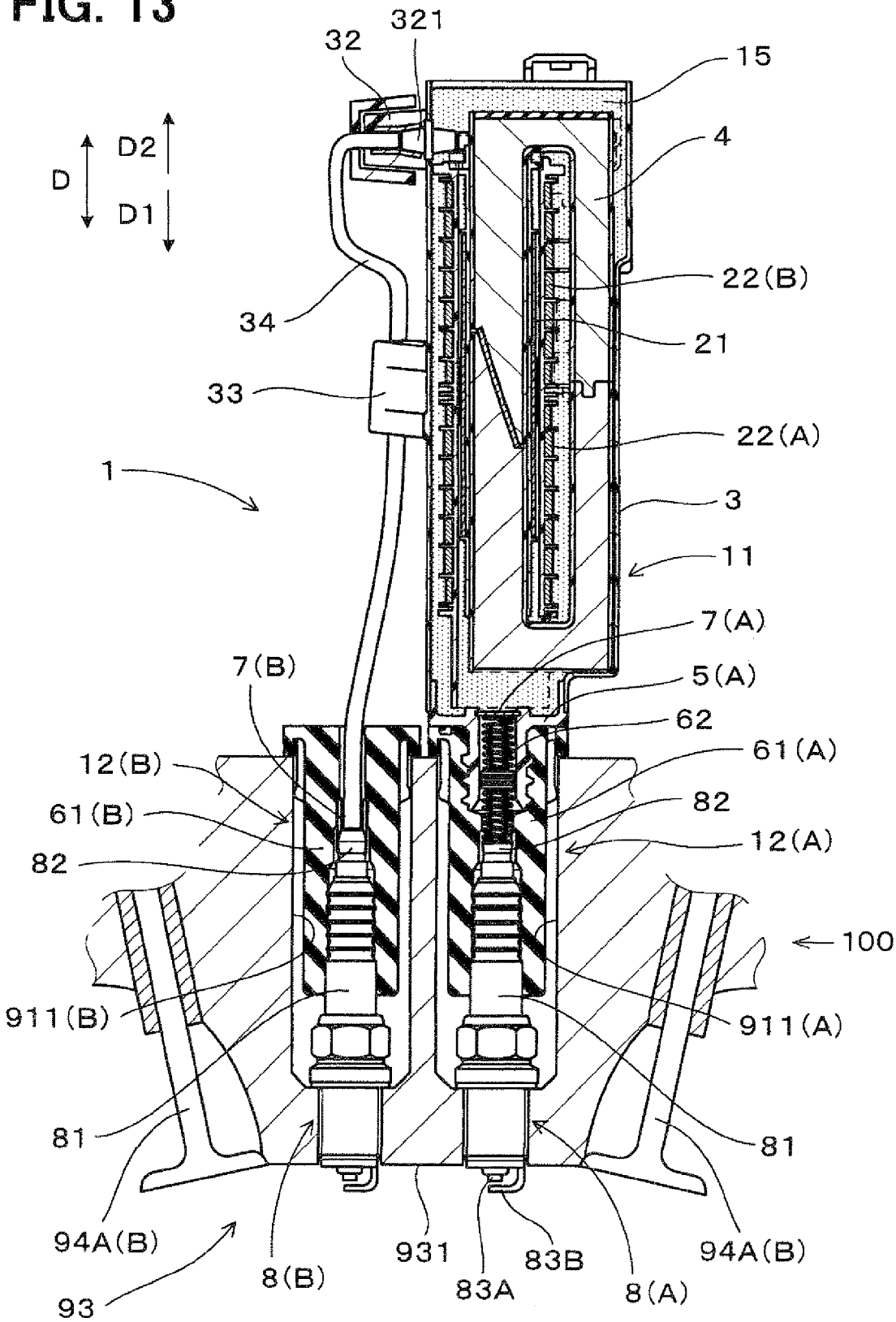
FIG. 13 is a longitudinal sectional view showing the ignition coil according to the second embodiment, the ignition coil being mounted to the cylinder of the engine.

As follows, the ignition coil 1 is described with reference to drawings. In the present embodiment, as shown in FIG. 13, the ignition coil 1 includes the primary coil 21, the secondary coil 22, and the soft magnetism core 4. The primary coil 21 and the secondary coil 22 have the common axis. One of the primary coil 21 and the secondary coil 22 is located radially outside of the other of the primary coil 21 and the secondary coil 22. When the primary coil 21 is energized, the primary coil 21 generates the magnetic flux, and the soft magnetism core 4 conducts the magnetic flux inside the inner circumferential periphery of the primary coil 21 and the secondary coil 22. The ignition coil 1 according to the present embodiment is provided to, for example, a dual ignition system (two-point ignition system) in which mixture gas is ignited at two locations in a combustion chamber of each cylinder 93 of the engine 100.

Figure 10:
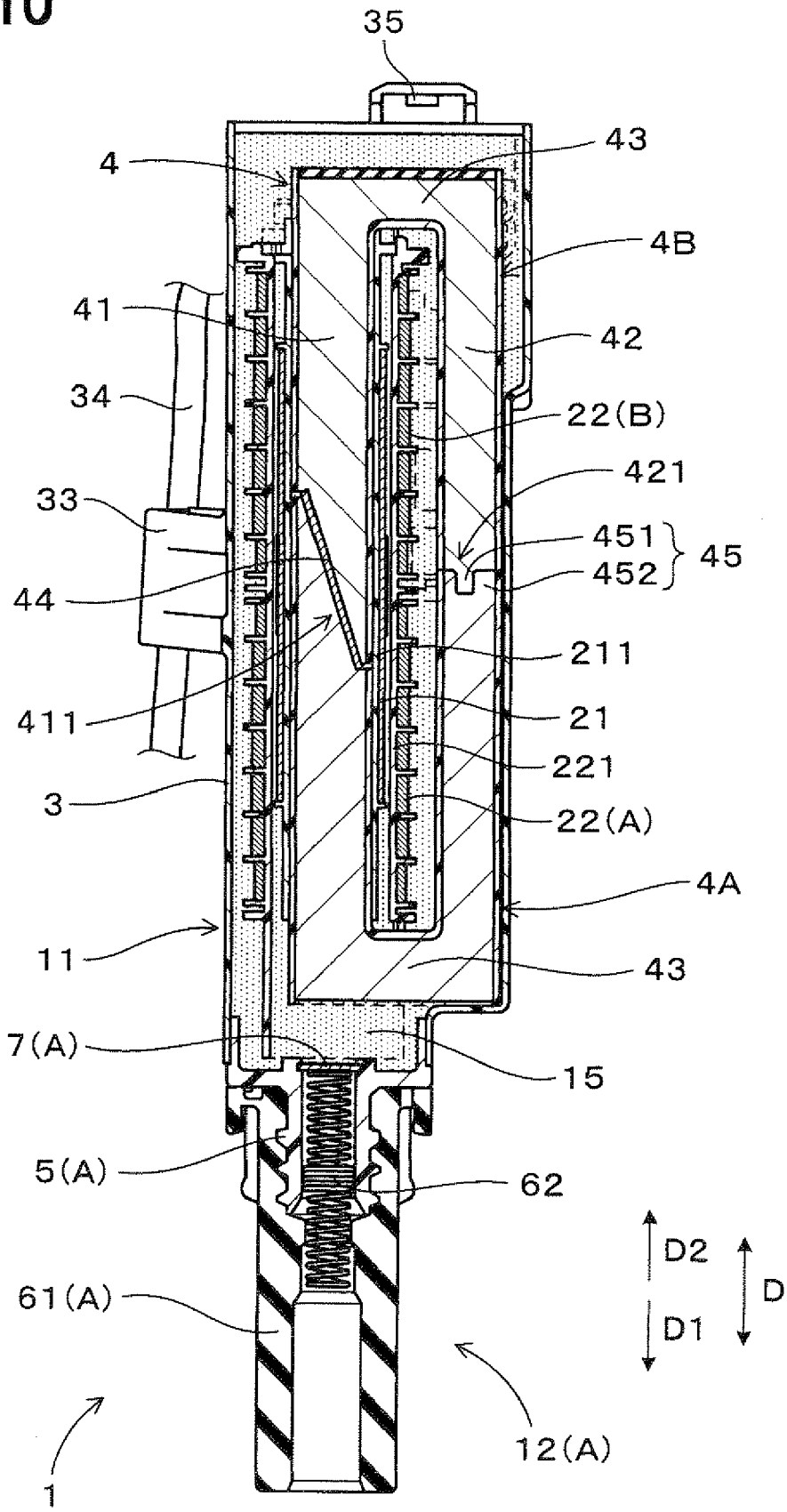
FIG. 10 is a longitudinal sectional view showing an ignition coil according to a second embodiment, the ignition coil being viewed from the second direction.
Figure 11:
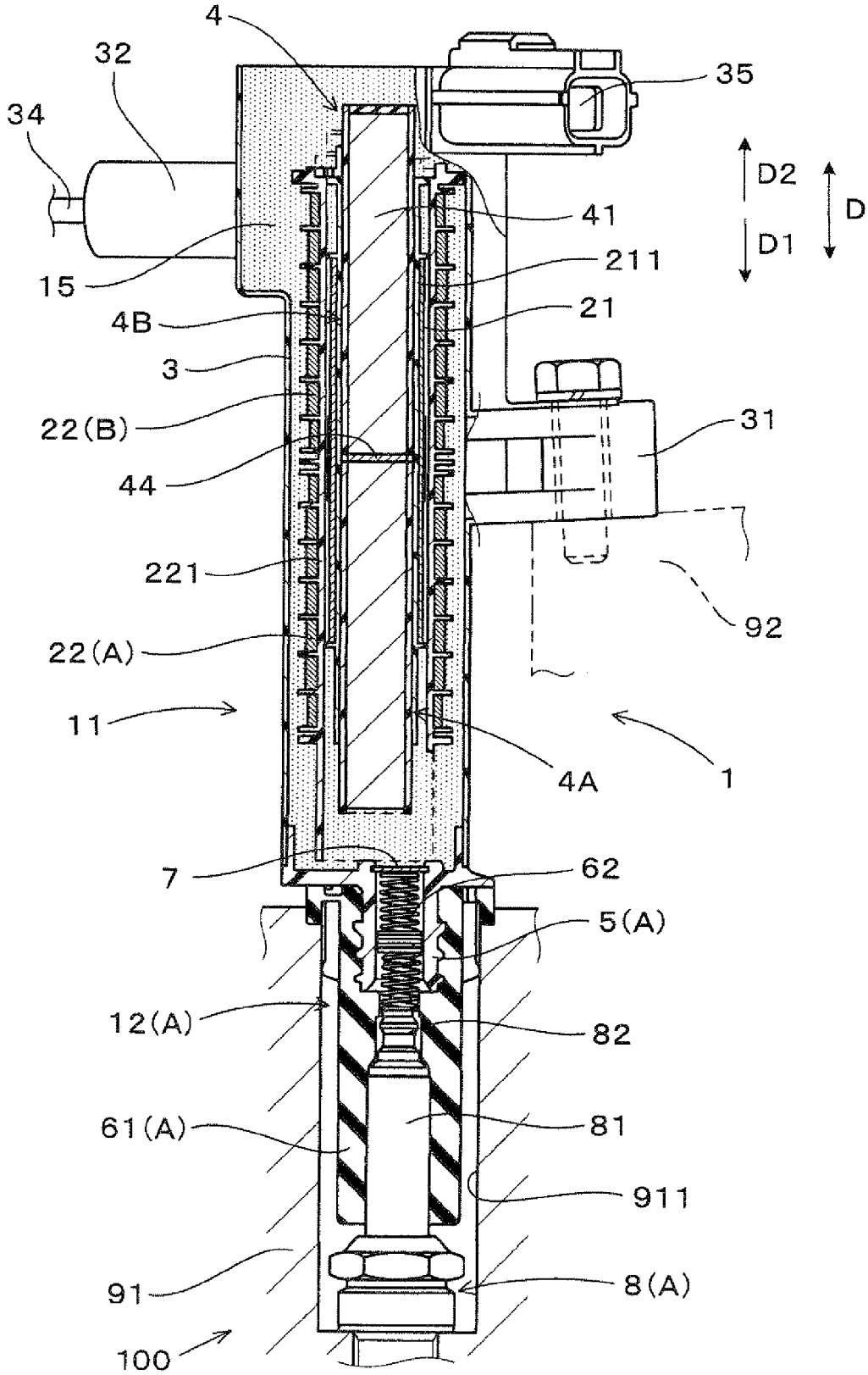
FIG. 11 is a longitudinal sectional view showing the ignition coil when being viewed from the first direction, the first direction being perpendicular to the second direction in FIG. 10.
Figure 12:
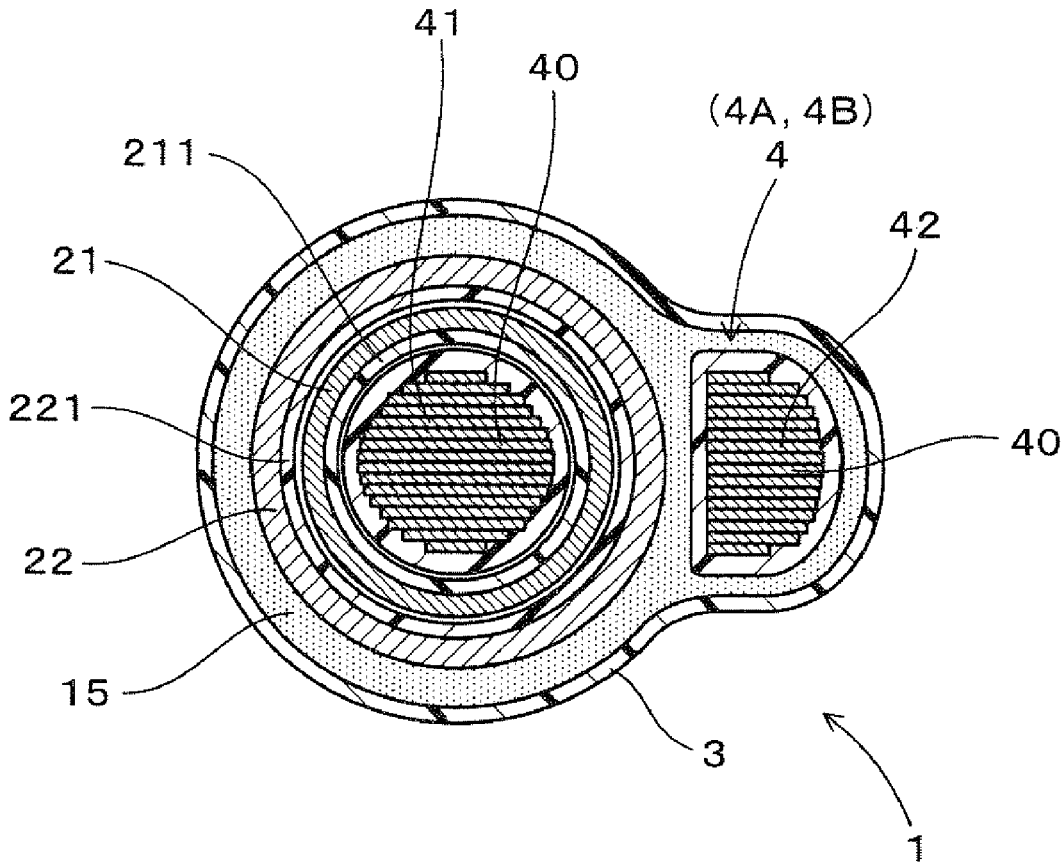
FIG. 12 is an axial sectional view showing the ignition coil according to the second embodiment.

Specifically, as show in FIGS. 10 to 12, the secondary coil 22 includes the first secondary coil 22A and the second secondary coil 22B. The first secondary coil 22A is located on the outer periphery of the secondary spool 221 on the one axial end side D1. The secondary spool 221 is formed of resin to be in the ring-shaped in cross section. The first secondary coil 22A is constructed by winding a secondary electric wire, which is applied with an electrically insulative coating, from the one axial end side D1 toward the other axial end side D2 in one winding direction. The second secondary coil 22B is located on the outer periphery of the secondary spool 221 on the other axial end side D2. The second secondary coil 22B is constructed by winding the secondary electric wire, which extends from the one end of the first secondary coil 22A, and the secondary electric wire is wound from the one axial end side D1 toward the other axial end side D2 in the winding direction opposite to the one winding direction. The present two secondary coils 22 are wound to be in the predetermined winding state. The two secondary coils 22 can be wound from either one of the one axial end side D1 or the other axial end side D2.

Figure 14:
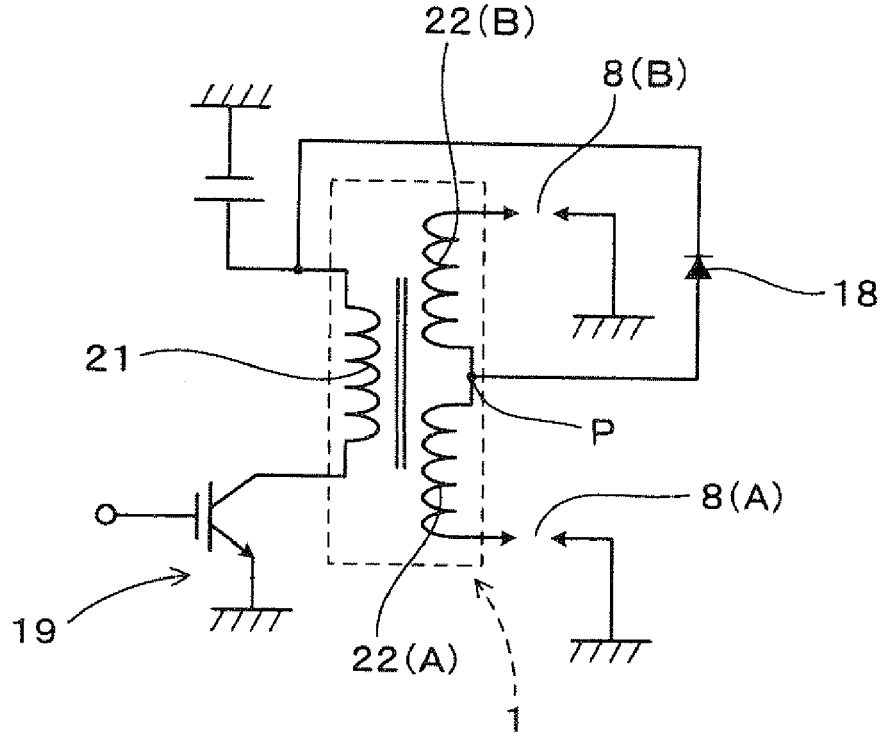
FIG. 14 is a schematic view showing an electric circuit for the ignition coil, according to the second embodiment.

As shown in FIGS. 13, 14, the first secondary coil 22A is electrically connected with the first sparkplug 8A. The first sparkplug 8A is attached to the first plughole 911A, which is provided to the cylinder 93 of the engine cylinder head 91. The second secondary coil 22B is electrically connected with the second sparkplug 8B. The second sparkplug 8B is attached to the second plughole 911B, which is provided to the cylinder 93 of the engine cylinder head 91. The primary coil 21, the secondary coil 22, and the soft magnetism core 4 are accommodated in the coil case 3 to construct the coil portion 11. The coil case 3 is made of resin.

The coil portion 11 has the end on the one axial end side D1, and the end is provided with a first plug mount portion 12A. The first plug mount portion 12A electrically connects the first secondary coil 22A with the first sparkplug 8A. The conducting cable 34 extends from the end of the coil portion 11 on the other axial end side D2. The conducting cable 34 is electrically connected with the second secondary coil 22B. The conducting cable 34 has the tip end provided with a second plug mount portion 12B. The second plug mount portion 12B electrically connects the conducting cable 34 with the second sparkplug 8B. In the present embodiment, the ignition coil 1 is configured such that the coil portion 11 is substantially erected upright outside the first plughole 911A in a state where the insulator portion 81 of the first sparkplug 8A is equipped with the first plug mount portion 12A inside the first plughole 911A.

As follows, the ignition coil 1 is described with reference to FIGS. 10 to 18. The ignition coil 1 according to the present embodiment is provided to, for example, a dual ignition system (two-point ignition system) in which mixture gas is ignited at two locations in a combustion chamber of each cylinder 93 of the engine 100. The ignition coil 1 according to the present embodiment is provided to, for example, each cylinder 93 of the cylinder head 91 of the engine 100. The combustion chamber of each cylinder 93 of the engine 100 has an upper portion having the first plughole 911 and a second plughole 911B. The first plughole 911 is attached with the first sparkplug 8A. The second plughole 911B is attached with the second sparkplug 8B.

As shown in FIG. 11 the primary coil 21 according to the present embodiment includes the primary spool 211, which is a cylindrical resin member and the primary wire, which is applied with an electrically insulative coating. The primary coil 21 is constructed by winding the primary wire around the outer circumferential periphery of the primary spool 211 by a primary winding number. The axial direction D of the coil portion 11 and the axial direction D of the first plug mount portion 12A are substantially in parallel with each other. That is, the axial direction D of both the primary coil 21 and the secondary coil 22 and the mounting direction of the first sparkplug 8A are substantially in parallel with each other. The coil portion 11 is substantially erected upright outside the first plughole 911A substantially in straight relative to the first plughole 911A. The cylinder head cover 92 is provided to the cylinder head 91. The coil portion 11 is fixed to the cylinder head cover 92 via the flange portion 31. The flange portion 31 is projected radially outward from the coil case 3.

As shown in FIGS. 10, 11, the first plug mount portion 12A includes a tower portion 5A, a conductive metal fitting 7A, a plug cap 61A, and the coil spring 62. The tower portion 5A is formed of resin, and connected with the coil portion 11. The metal fitting 7A is electrically connected with a high-voltage end of a winding of the first secondary coil 22A. The plug cap 61A is formed of rubber, and press-fitted with the insulator portion 81 of the sparkplug 8. The insulator portion 81 has the tip end provided with the terminal portion 82. The coil spring 62 electrically conducts the metal fitting 7A with the terminal portion 82. As shown in FIG. 13, a second plug mount portion 12B includes a plug cap 61B and a conductive metal fitting 7B. The plug cap 61B supports an end of the conducting cable 34. The plug cap 61B is formed of rubber, and press-fitted with the insulator portion 81 of the second sparkplug 8B. The conductive metal fitting 7B is electrically connected with the conducting cable 34 The conductive metal fitting 7B electrically conducts the conducting cable 34 with the terminal portion 82 on the tip end of the insulator portion 81.

Figure 16:
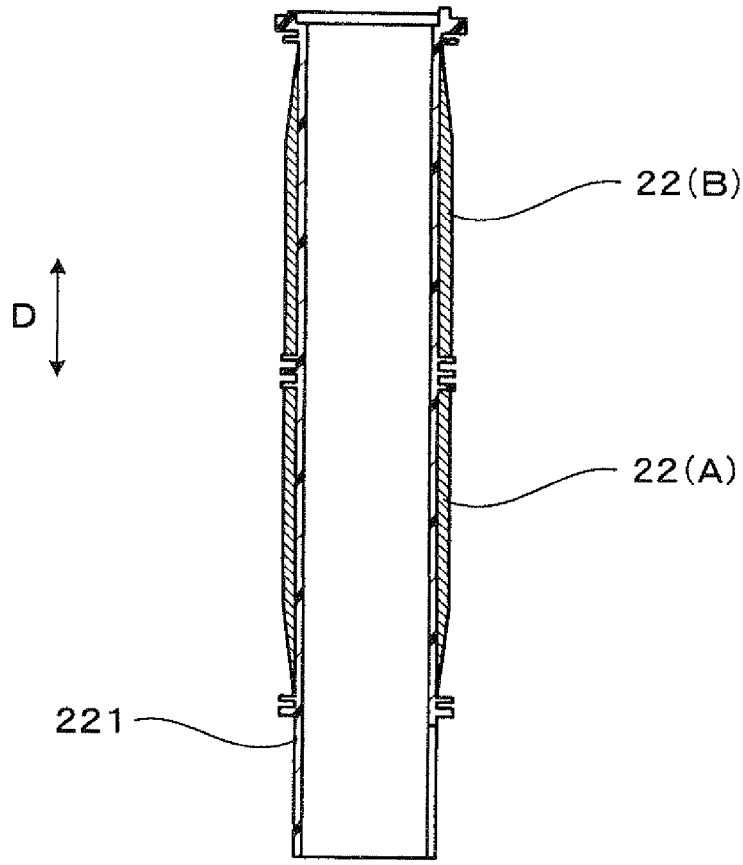
FIG. 16 is a schematic view showing another secondary coil according to the second embodiment.

The primary coil 21 according to the present embodiment is located radially inside the two secondary coils 22. The primary coil 21 has a center portion with respect to the axial direction D, and the center portion is located radially inside of an intermediate portion between the first secondary coil 22A and the second secondary coil 22B. The intermediate portion is located between the first secondary coil 22A and the second secondary coil 22B with respect to the axial direction D. In the present embodiment, multiple flanges are provided to project radially outward from the outer circumferential periphery of the secondary spool 221, and the multiple flanges divide the two secondary coils 22 into multiple winding regions with respect to the axial direction D. In this manner, the two secondary coils 22 are formed by a divisional winding. Alternatively, as shown in FIG. 16, the two secondary coils 22 may be constructed by winding the secondary electric wire to form inclined winding layers each reducing in diameter toward the high-voltage side, and stacking the inclined winding layers toward the high-voltage side, In this manner, the two secondary coils 22 are formed by an inclined winding. In this case, the outer diameter of the secondary coil 22 can be further reduced.

In the present embodiment, the primary coil 21 is wound in the same winding direction as that of the second secondary coil 22B from the one axial end side D1 toward the other axial end side D2. The primary coil 21 is wound in the opposite winding direction to that of the first secondary coil 22A from the one axial end side D1 toward the other axial end side D2. As shown in FIG. 14, in the present embodiment of the ignition coil 1, the winding end of the first secondary coil 22A on the one axial end side D1 is in a negative potential when the electricity supply to the primary coil 21 is terminated. Thus, a center electrode 83A of the first sparkplug 8A, which is electrically connected with the winding end, performs negative electric discharge to an external ground electrode 83B being in ground potential. The winding end of the second secondary coil 22B on the other axial end side D2 is also in a negative potential when the electricity supply to the primary coil 21 is terminated. Thus, the center electrode of the second sparkplug 8B, which is electrically connected with the winding end, performs negative electric discharge to the external ground electrode being in ground potential.

Figure 15:
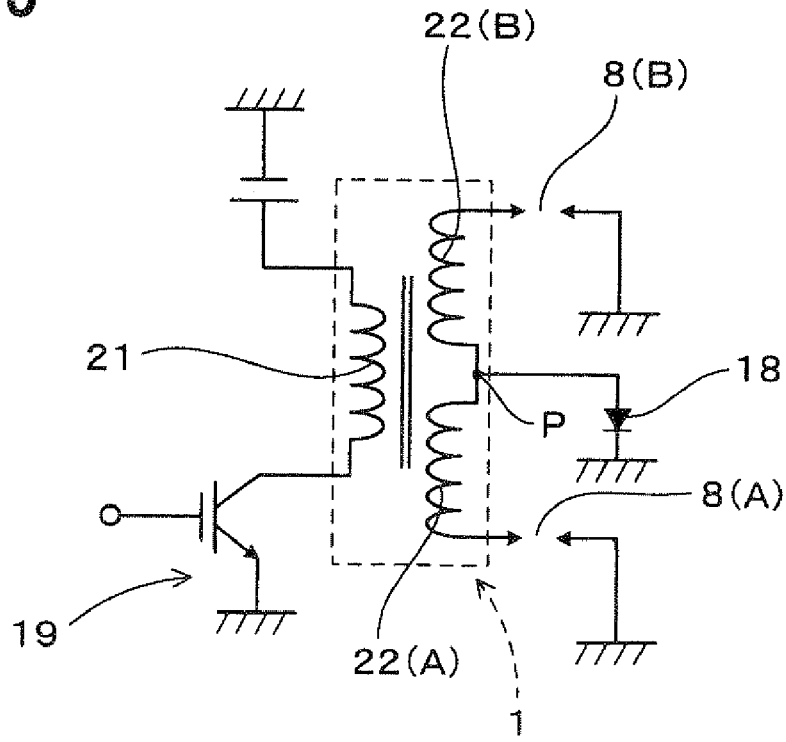
FIG. 15 is another schematic view showing an electric circuit for the ignition coil, according to the second embodiment.

The first secondary coil 22A and the second secondary coil 22B therebetween have the halfway point P to which the anode terminal of the diode 18 is electrically connected. The diode 18 has the cathode terminal, which is connected to the positive pole end of the primary coil 21. The primary coil 21 is connected with the battery via the positive pole end. Alternatively, as shown in FIG. 15, the cathode terminal of the diode 18 may be connected with a ground.

Referring to FIG. 10, the present soft magnetism core 4 is constructed of the core center portion 41, the core outer portion 42, and the pair of core interconnecting portions 43 to be in the shape of the square annulus. The core center portion 41 is located on the radially inner side of the primary coil 21 and the secondary coil 22. The core outer portion 42 is located on the radially outer side of the part of the primary coil 21 the secondary coil 22. Each of the pair of core interconnecting portions 43 interconnects the core outer portion 42 with the core center portion 41 at both ends of each of the primary coil 21 and the secondary coil 22 on both the axial end sides D1, D2. The soft magnetism core 4 is formed by connecting the two core members 4A, 4B with the ends of each of the primary coil 21 and the secondary coil 22 from both axial end sides D1, D2. As shown in FIG. 12, the two core members 4A, 4B are constructed by stacking multiple electromagnetic plates, each of which is made of a soft magnetism material, in the second direction. The second direction is perpendicular to the first direction, in which the core center portion 41 and the core outer portion 42 are arranged.

As shown in FIG. 10, the two core members 4A, 4B therebetween have the connecting portions 411, 421. One of the connecting portions 411, 421 defines the core gap 44 provided with the permanent magnet. The other of the connecting portions 411, 421 defines the joint portion 45 via which the end surfaces of the two core members 4A, 4B are in contact with each other. In the present embodiment, the core gap 44 is located in the core center portion 41 in the state where the core gap 44 is inclined with respect to the axial direction D of the coil portion 11. In the present embodiment, the projected portion 451 is provided to one of the core members 4A, 4B, and the recessed portion 452 is provided to the other of the core members 4A, 4B. The projected portion 451 is fitted to the recessed portion 452 in the joint portion 45.

Referring to FIG. 11, the connector portion 35 projects radially outward from the outer circumferential periphery of the end of the coil case 3 on the other axial end side D2. The connector portion 35 is provided with the conduction pin for conducting electricity to each winding end of the primary coil 21. The harness is pulled out from the connector portion 35. The primary coil 21 is connected with the igniter device via the harness. The igniter device is provided outside the ignition coil 1. As shown in FIG. 14, the igniter device 19 includes the switching control circuit, which controls supplying of electricity to the primary coil 21 and termination of the electricity in response to the signal transmitted from the electronic control unit (ECU).

Referring to FIGS. 10, 12, the cable drawing portion 32 is projected radially outward from the outer circumferential periphery of the end of the coil case 3 on the other axial end side D2. The conducting cable 34 is drawn from the cable drawing portion 32. The end of the high-voltage winding of the second secondary coil 22B on the other axial end side D2 is electrically connected with the conducting cable 34 via a drawing metal fitting 321 provided to the cable drawing portion 32. A cable support portion 33 is provided to the outer circumferential periphery of the coil case 3. The cable support portion 33 holds an intermediate portion of the conducting cable 34, which extends from the cable drawing portion 32. The conducting cable 34 is held by the cable drawing portion 32 and the cable support portion 33, whereby the conducting cable 34, which is drawn from the cable drawing portion 32, can be steadily aligned.

Referring to FIGS. 10, 12, the coil portion 11, i.e., the coil case 3 has a clearance therein, and the primary coil 21, the secondary coil 22, the soft magnetism core 4, and the like are located in the clearance. The tower portion 5 and the coil case 3 therebetween define a gap, and the gap is filled with thermosetting insulating resin 15 such as epoxy resin.

In the present embodiment, the ignition coil 1 is capable of generating a spark between the electrodes 83A, 83B of each of the two sparkplugs 8A, 8B. Referring to FIG. 14, when the switching control circuit 19 supplies electricity to the primary coil 21 in response to the instruction transmitted from the ECU, the soft magnetism core 4 generates a magnetic field to pass therethrough. Subsequently, when the electricity supply to the primary coil 21 is terminated, the primary coil 21 therein causes voltage by self-induction, and the two secondary coils 22 therein cause high-voltage induced electromotive force (secondary voltage) by mutual induction. Thus, a spark can be generated between the electrodes 83A, 83B of the first sparkplug 8A, which is electrically connected with the first secondary coil 22A. Another spark can be also generated between the electrodes of the second sparkplug 8B, which is electrically connected with the second secondary coil 22B.

The ignition coil 1 applied to the two-point ignition system according to the present embodiment has a structure in which the distance between the two plugholes 911A, 911B provided in each engine cylinder 93 is reduced. Specifically, the insulator portion 81 of the first sparkplug 8A, which is attached to the first plughole 911A, and the insulator portion 81 of the second sparkplug 8B, which is attached to the second plughole 911B, are respectively mounted to the first plug mount portion 12A and the second plug mount portion 12B. In the present condition, the coil portion 11 of the ignition coil 1 is erected upright, i.e., the coil portion 11 stands straight on the upper side of the first plughole 911A. In addition, only the conducting cable 34 is located on the upper side of the second plughole 911B.

Therefore, according to the ignition coil 1 applied to the two-point ignition system of present embodiment, a constraint of a space outside the plugholes 911A, 911B can be significantly reduced. Therefore, the distance between the first plughole 911A and the second plughole 911B can be determined small. In addition, the two plugholes 911A, 911B can be provided at suitable positions in the engine cylinder 93. Furthermore, in the present embodiment, the coil portion 11 is erected upright outside the plugholes 911A, 911B. Therefore, in the multicylinder engine 100 having the multiple cylinders 93, flexibility in the space for the ignition coils 1 between the adjacent cylinders 93 can be enhanced.

Figure 17:
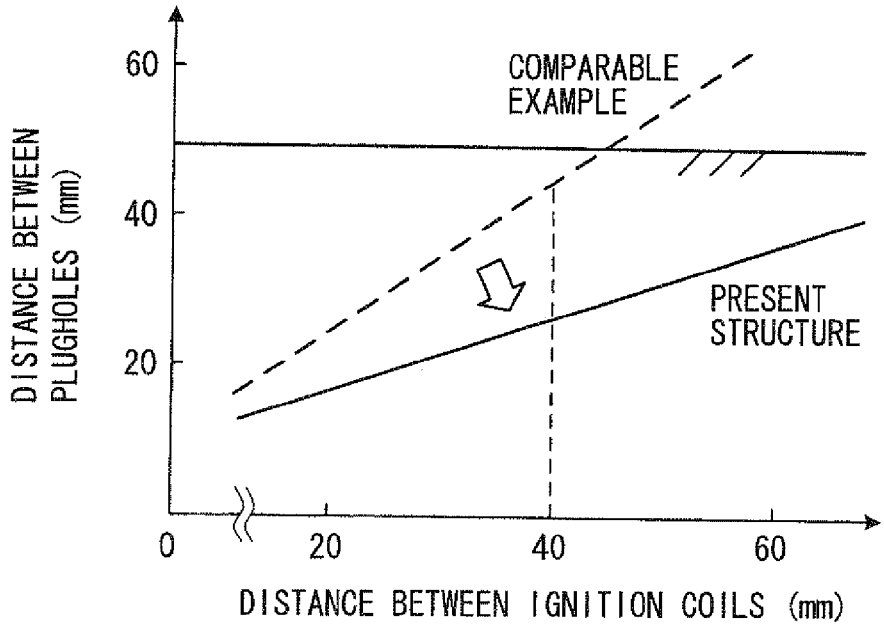
FIG. 17 is a graph showing a relationship between a width of the ignition coil and a distance between adjacent two plugholes.

In FIG. 17, the comparative example has a structure having two ignition coils respectively including coil portions. In the present structure, two ignition coils are provided with the one coil portion. For example, in the comparative example, when the sum total of the width of the two ignition coils is 40 mm, the distance between the plugholes 911A, 911B needs to be equal to or greater than 40 mm. By contrast, according to the ignition coil 1 having the present structure, only the one coil portion 11 exists on the plughole 911A. Therefore, according to the present structure, when the width of the ignition coil is 40 mm, the distance between the plugholes 911A, 911B can be reduced to about 20 mm.

Figure 18:
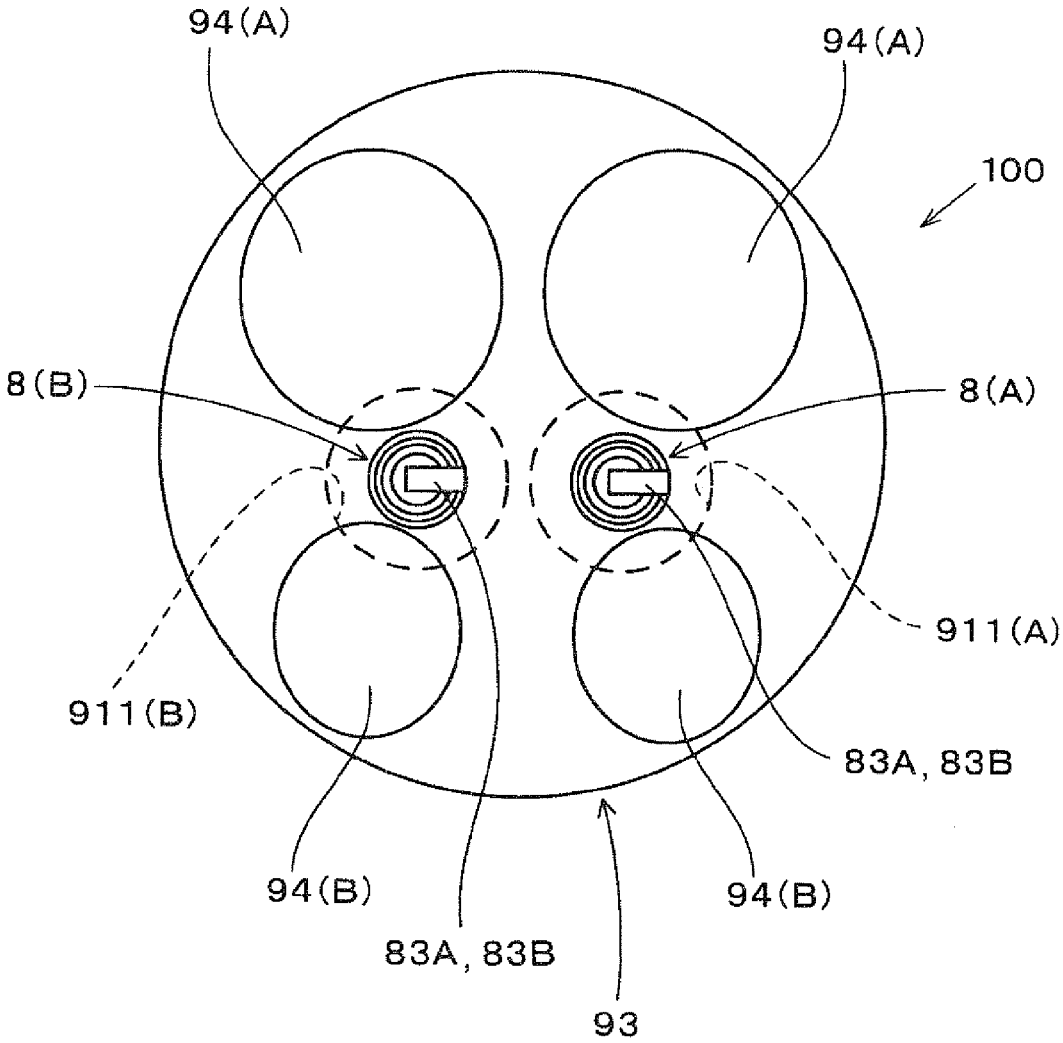
FIG. 18 is a schematic view showing the ignition coil mounted to the cylinder having four valves.

As shown in FIG. 18, the ignition coil 1 according to the present embodiment is provided to the cylinder 93 having four valves 94, for example. In FIG. 18, two sparkplugs 8A, 8B are provided to a space between a location, in which two intake valves 94A are provided, and a location, in which two exhaust valves 94B are provided. The two sparkplugs 8A, 8B are arranged in parallel with each other along the direction in which the two intake valves 94A are arranged, i.e., along the direction in which the two exhaust valves 94B are arranged. The coil portion 11 of the ignition coil 1 is erected upright on the upper side of the first sparkplug 8A. The cylinder 93 has the space, to which the ignition coil 1 is mounted, and the space has a constraint. Nevertheless, the ignition coil 1 according to the present embodiment is capable of producing an operation effect and capable of being mounted to the limited space around the cylinder 93, even when the distance between the plugholes 911A, 911B is reduced.

In addition, according to the ignition coil 1 of the present embodiment, two ignition coils need not be arranged side by side on each of the cylinders 93 of the cylinder head 91. Therefore, a sufficient space can be secured around the ignition coil 1. In the present structure, heat dissipation of the ignition coil 1 can be enhanced, whereby heat stress exerted to the ignition coil 1 can be reduced. Thus, flexibility in strength design of the heat stress exerted to the ignition coil 1 can be enhanced. In addition, according to the ignition coil 1 in the present embodiment, two ignition coils need not be arranged side by side. Therefore, flexibility in layout design of peripheral components around the ignition coil 1 can also be enhanced.

Third Embodiment

Figure 19:
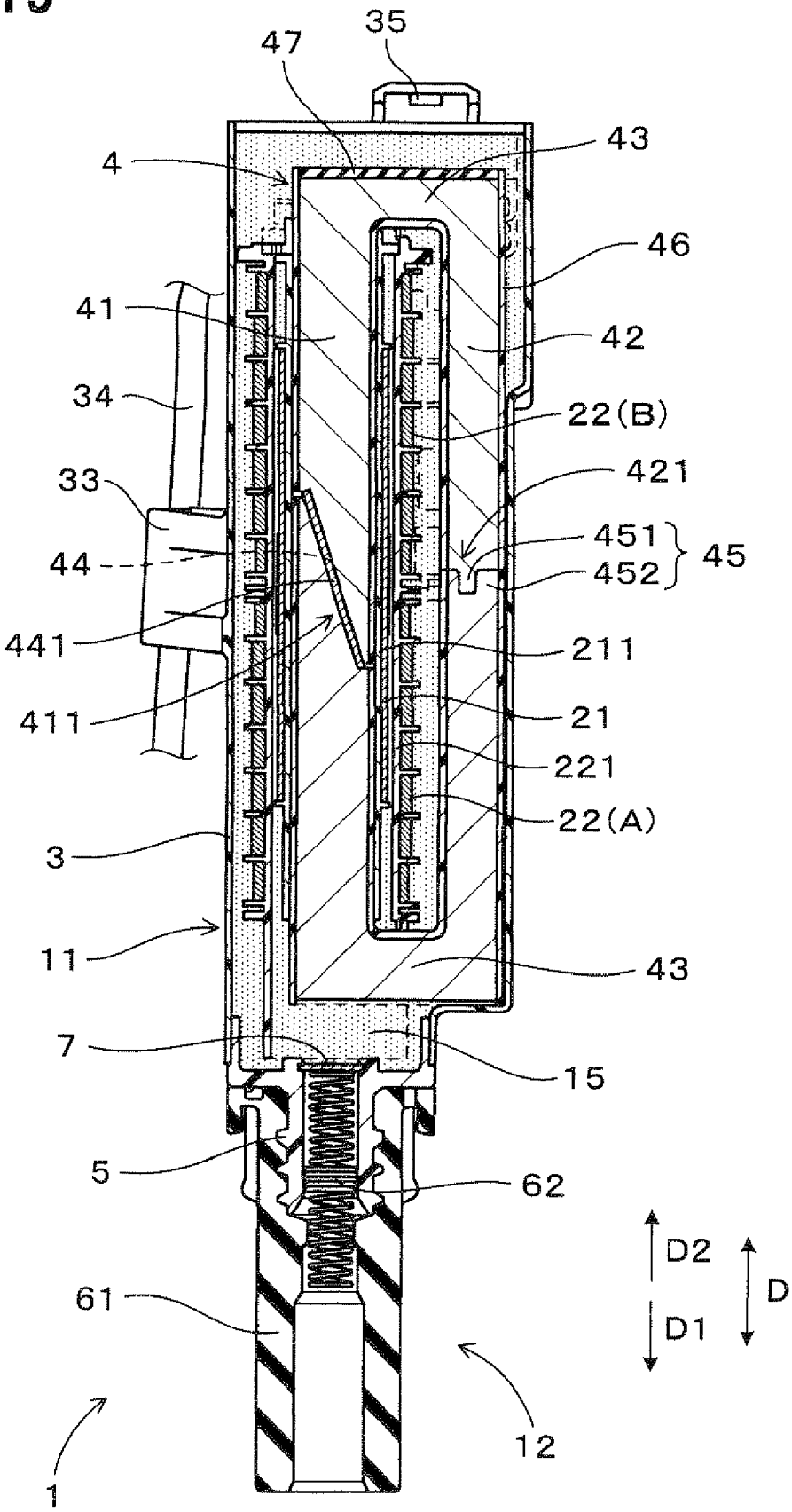
FIG. 19 is a longitudinal sectional view showing an ignition coil according to a third embodiment, the ignition coil being viewed from the second direction.
Figure 20:
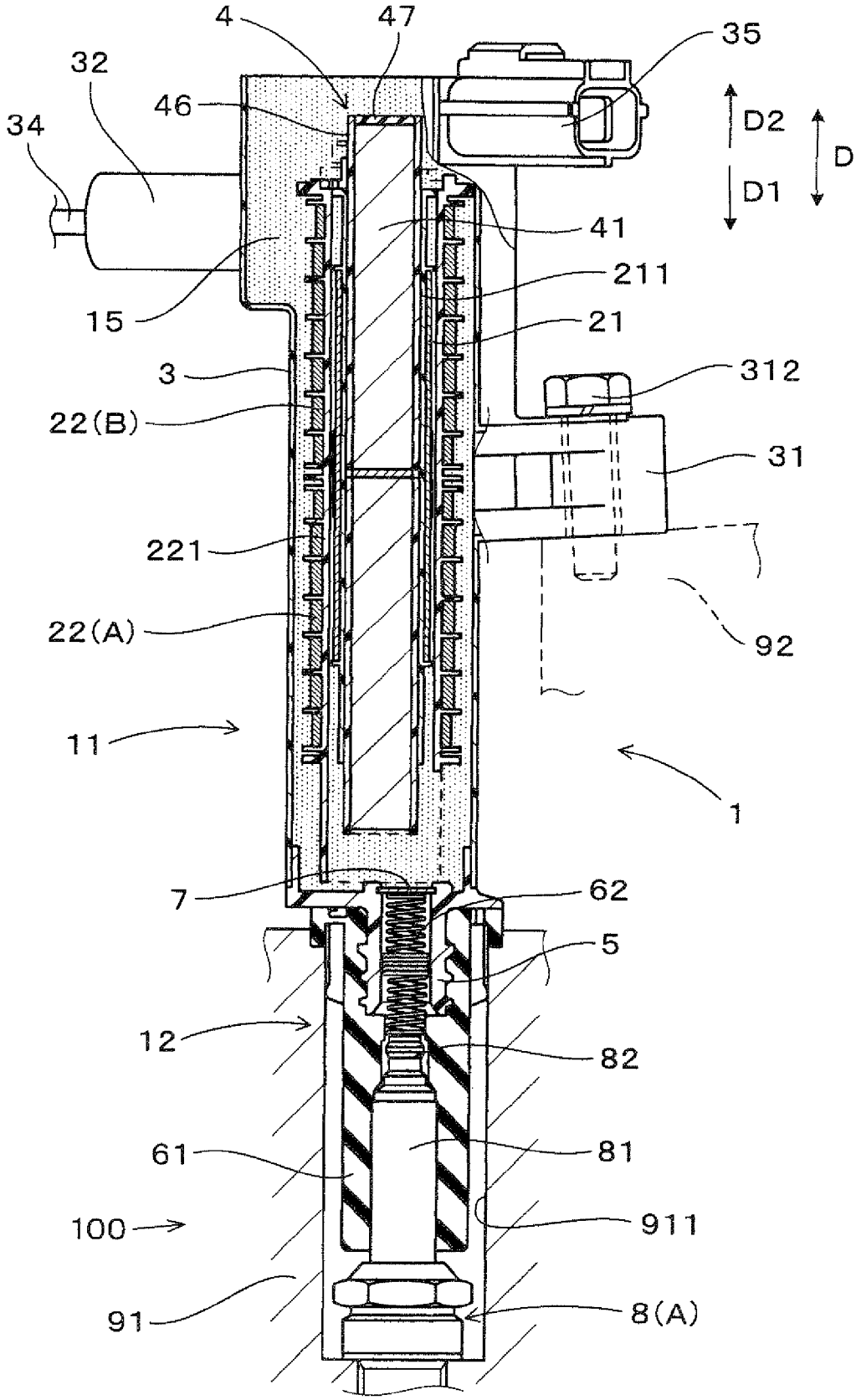
FIG. 20 is a longitudinal sectional view showing the ignition coil when being viewed from the first direction, the first direction being perpendicular to the second direction in FIG. 19.

As follows, the ignition coil 1 is described with reference to drawings. In the present embodiment, as shown in FIGS. 19, 20, the ignition coil 1 includes the primary coil 21, the secondary coil 22, and the closed magnetic path core 4. The primary coil 21 and the secondary coil 22 have the common axis. One of the primary coil 21 and the secondary coil 22 is located radially outside of the other of the primary coil 21 and the secondary coil 22. When the primary coil 21 is energized, the primary coil 21 generates the magnetic flux. The closed magnetic path core 4 conducts the magnetic flux inside the inner circumferential periphery of the primary coil 21 and the secondary coil 22, the outer circumferential periphery of the primary coil 21 and the secondary coil 22, and ends on both the one axial end side D1 and the other axial end side D2. The present closed magnetic path core 4 is constructed of the core center portion 41, the core outer portion 42, and the pair of core interconnecting portions 43 to be in the shape of a square annulus. The core center portion 41 is located on the radially inner side of the primary coil 21 and the secondary coil 22. The core outer portion 42 is located on the radially outer side of the part of the primary coil 21 and the secondary coil 22. Each of the pair of core interconnecting portions 43 interconnects the core outer portion 42 with the core center portion 41 at both ends of each of the primary coil 21 and the secondary coil 22 on both the axial end sides D1, D2.

Figure 21:
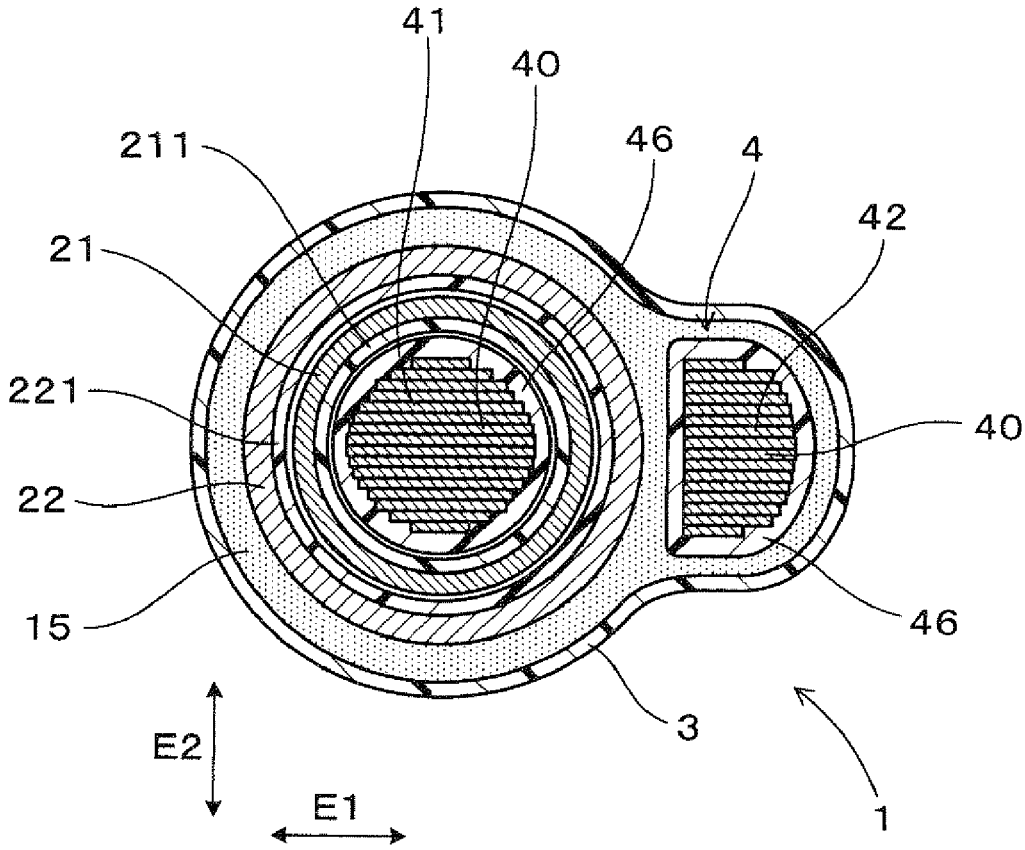
FIG. 21 is an axial sectional view showing the ignition coil according to the third embodiment.
Figure 22:
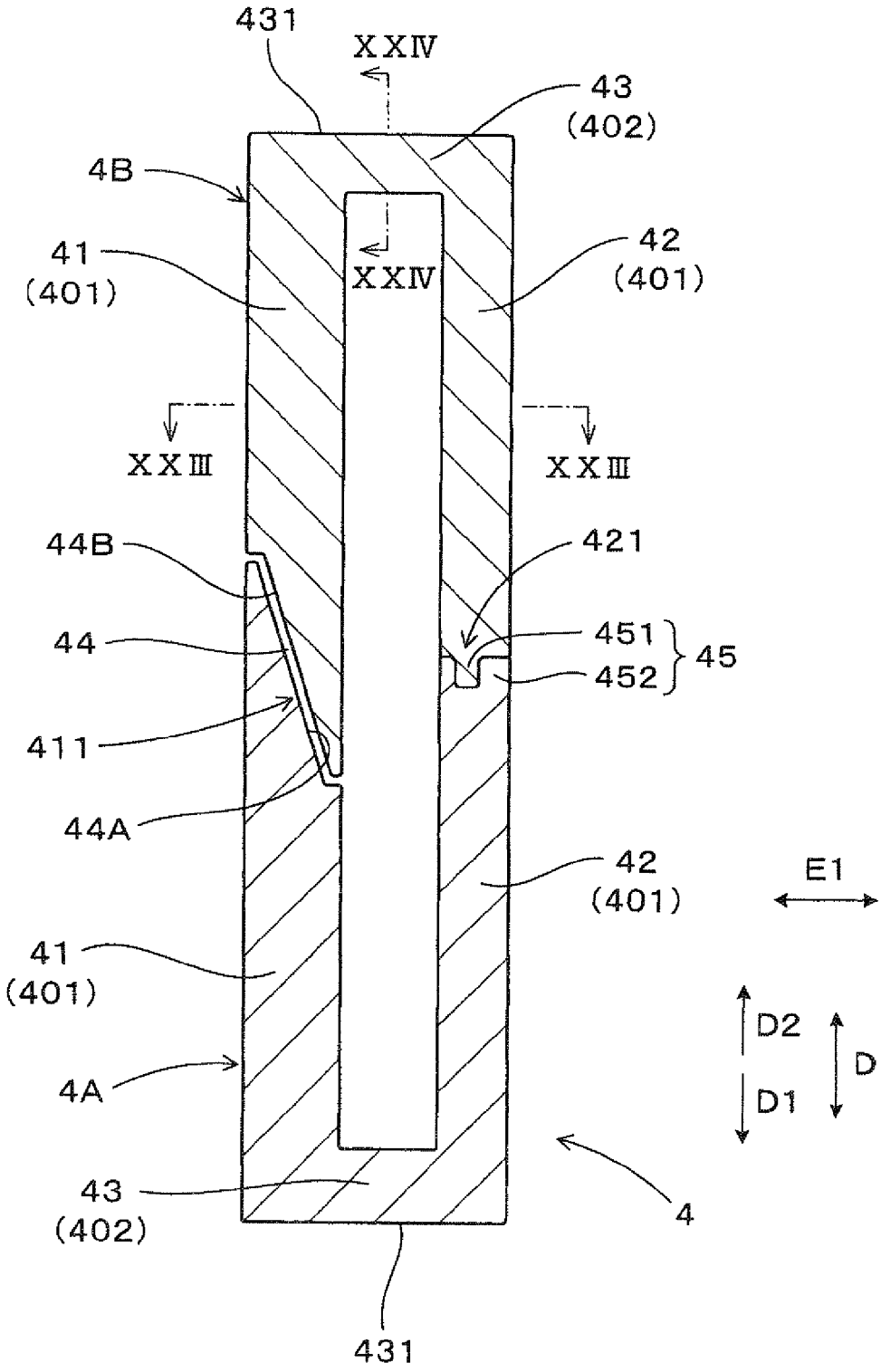
FIG. 22 is a schematic view showing a closed magnetic path core according to the third embodiment.
Figure 23:
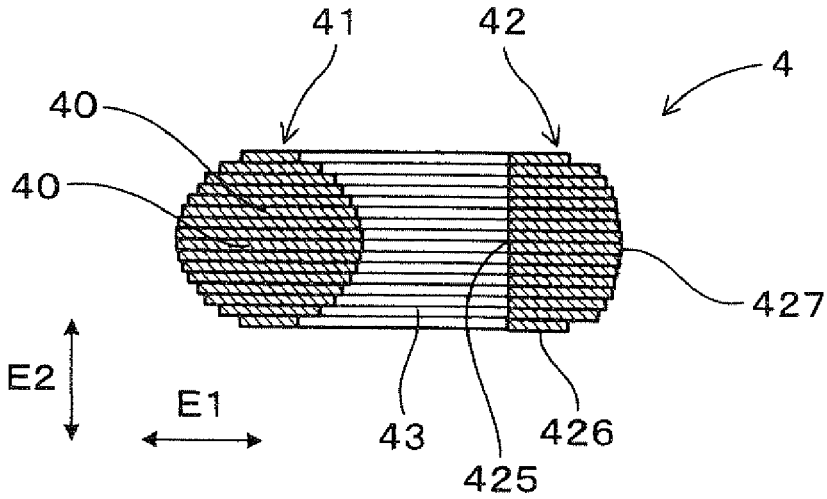
FIG. 23 is an axial sectional view taken along the line XXIII-XXIII in FIG. 22 and showing a core center portion and a core outer portion of the closed magnetic path core according to the third embodiment.

As shown in FIG. 22, the closed magnetic path core 4 is constructed by connecting the two core members 4A, 4B. As shown in FIGS. 21, 23, the two core members 4A, 4B are constructed by stacking the multiple electromagnetic plates 40 in a second direction E2. The second direction E2 is perpendicular to the first direction E1, in which the core center portion 41 and the core outer portion 42 are arranged. Each of the multiple electromagnetic plates 40 is made of a soft magnetism material. The stacked multiple electromagnetic plates 40 are coupled to each other by bonding or crimping. As shown in FIGS. 19, 22, the two core members 4A, 4B therebetween have the connecting portions 411, 421. One of the connecting portions 411, 421 defines the core gap 44 provided with the permanent magnet. The other of the connecting portions 411, 421 define the joint portion 45 via which the end surfaces of the two core members 4A, 4B are in contact with each other. Referring to FIGS. 21, 23, in the present embodiment, the width of the electromagnetic plates 40 is different from each other, whereby the core center portion 41 is substantially in a circular shape in cross section.

As follows, the ignition coil 1 is described with reference to FIGS. 19 to 31. The ignition coil 1 according to the present embodiment is provided to, for example, a dual ignition system (two-point ignition system) in which mixture gas is ignited at two locations in a combustion chamber of each cylinder of the engine. The ignition coil 1 according to the present embodiment is provided to, for example, each cylinder of the cylinder head 91 of the engine 100. Each cylinder 91 of the engine 100 has an upper portion having the first plughole 911 and the second plughole. The first plughole 911 is attached with the first sparkplug 8A. The second plughole is attached with the second sparkplug 8B.

As shown in FIGS. 19, 20, the primary coil 21 according to the present embodiment includes the primary spool 211, which is the cylindrical resin member, and the primary wire, which is applied with the electrically insulative coating. The primary coil 21 is constructed by winding the primary wire around the outer circumferential periphery of the primary spool 211 by the primary winding number. In the present embodiment, the ignition coil 1 includes the two secondary coils 22, which are connected in series with respect to the axial direction D. Specifically, in the present embodiment, the secondary coil 22 includes the first secondary coil 22A and the second secondary coil 22B. The first secondary coil 22A is located on the outer periphery of the end of the secondary spool 221 on the one axial end side D1. The secondary spool 221 is formed of resin to be in the ring-shaped in cross section. The first secondary coil 22A is constructed by winding the secondary electric wire, which is applied with an electrically insulative coating, from the one axial end side D1 toward the other axial end side D2 in one winding direction. The second secondary coil 22B is located on the outer periphery of the end of the secondary spool 221 on the other axial end side D2. The second secondary coil 22B is constructed by winding the secondary electric wire, which extends from the one end of the first secondary coil 22A, and the secondary electric wire is wound from the one axial end side D1 toward the other axial end side D2 in the winding direction opposite to the one winding direction. The present two secondary coils 22 are wound to be in the predetermined winding state. The two secondary coils 22 can be wound from either one of the one axial end side D1 or the other axial end side D2.

Figure 25:
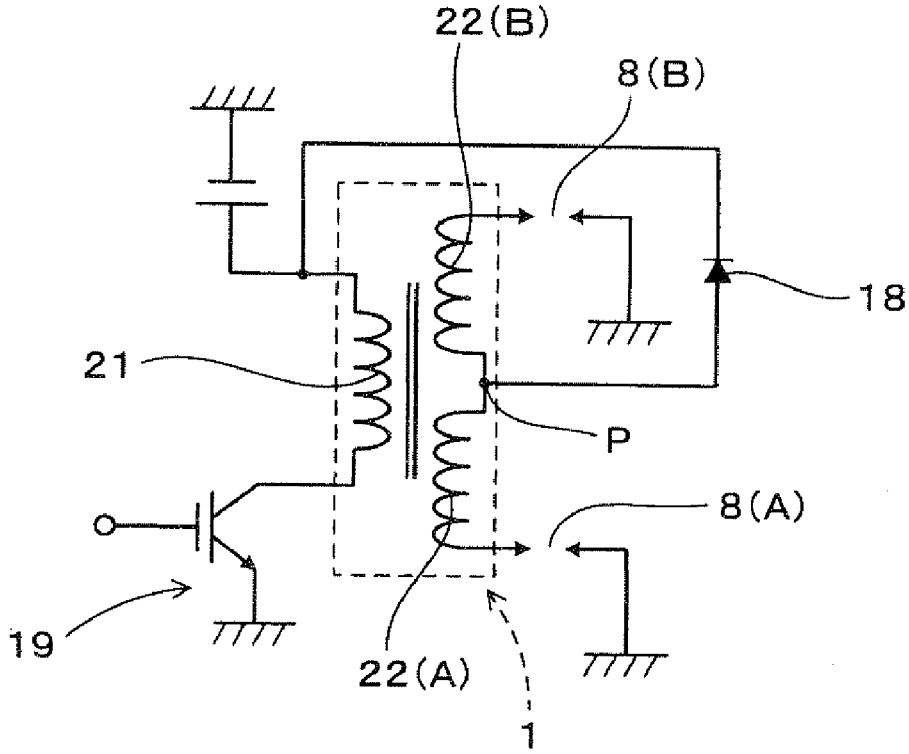
FIG. 25 is a schematic view showing an electric circuit for the ignition coil, according to the third embodiment.
Figure 32:
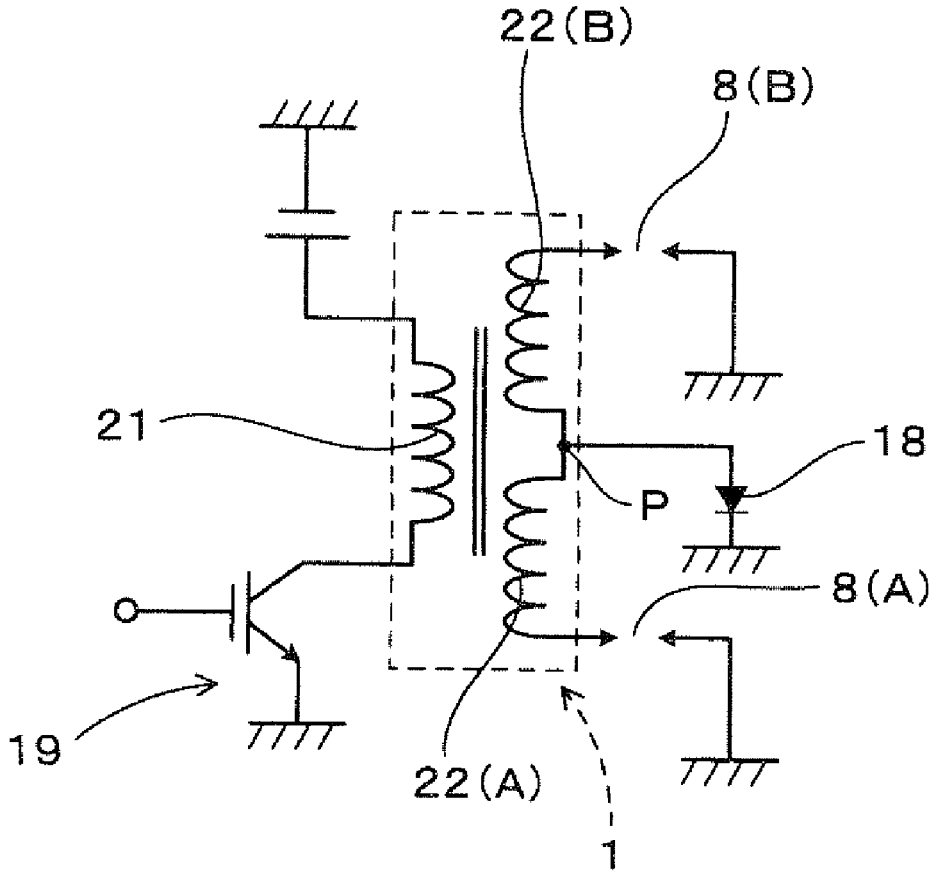
FIG. 32 is a schematic view showing another electric circuit for the ignition coil, according to the third embodiment.

As shown in FIG. 25, the first secondary coil 22A is electrically connected with the first sparkplug 8A, and the second secondary coil 22B is electrically connected with the second sparkplug 8B. The first secondary coil 22A and the second secondary coil 22B therebetween have the halfway point P to which the anode terminal of the diode 18 is electrically connected. The diode 18 has the cathode terminal, which is connected to the positive pole end of the primary coil 21. The primary coil 21 is connected with the battery via the positive pole end. Alternatively, as shown in FIG. 32, the cathode terminal of the diode 18 may be connected with a ground.

As shown in FIGS. 19, 20, in the present embodiment, the total length of the two secondary coils 22 is greater than the length of the primary coil 21 with respect to the axial direction thereof. The primary coil 21 is inserted into the inner circumferential periphery of the secondary coil 22. The coil portion 11 includes the coil case 3 accommodating the primary coil 21, the secondary coil 22, and the closed magnetic path core 4 via the insulating resin 15. The insulating resin 15 is, for example, epoxy resin. The first plug mount portion 12 is provided to the end of the coil portion 11 on the one axial end side D1. The first plug mount portion 12 is equipped with the first sparkplug. The conducting cable 34 extends from the end of the coil portion 11 on the other axial end side D2. The conducting cable 34 is electrically connected with the second secondary coil 22. The conducting cable 34 has the tip end provided with the second plug mount portion. The second plug mount portion electrically connects the conducting cable 34 with the second sparkplug. Referring to FIG. 20, in the present embodiment, the ignition coil 1 is constructed such that the first plug mount portion 12 is located in the plughole 911 of the cylinder head 91 of the engine 100 and the coil portion 11 is located outside the plughole 911.

The first plug mount portion 12 includes the tower portion 5, the conductive metal fitting 7, the plug cap 61, and the coil spring 62. The tower portion 5 is formed of resin, and connected with the coil portion 11. The metal fitting 7 is electrically connected with the high-voltage end of the winding of the secondary coil 22. The plug cap 61 is formed of rubber, and press-fitted with the insulator portion 81 of the sparkplug 8. The insulator portion 81 has the tip end provided with the terminal portion 82. The coil spring 62 electrically conducts the metal fitting 7 with the terminal portion 82. The second plug mount portion includes the conductive metal fitting, the plug cap, and the engaging metal fitting. The conductive metal fitting is electrically connected with the conducting cable 34. The plug cap is formed of rubber, and press-fitted with the insulator portion of the second sparkplug 8B. The engaging metal fitting electrically conducts the conductive metal fitting with the terminal portion of the second sparkplug 8B.

As shown in FIG. 22, in the present embodiment, the two core members 4A, 4B include the first core member 4A and the second core member 4B. The first core member 4A is constructed by continuously forming a portion of the core center portion 41 on the one axial end side D1 with a portion of the core outer portion 42 on the one axial end side D1 via one of the core interconnecting portions 43. The second core member 4B is constructed by continuously forming a portion of the core center portion 41 on the other axial end side D2 with a portion of the core outer portion 42 on the other axial end side D2 via the other of the core interconnecting portions 43. The end of the core center portion 41 of the first core member 4A on the one axial end side D1 has an end surface 44A. The end of the core center portion 41 of the second core member 4B on the other axial end side D2 has an end surface 44B. The end surface 44A and the end surface 44B therebetween define the core gap 44.

Referring to FIGS. 19, 22, the core gap 44 is inclined with respect to the axial direction D of the primary coil 21 and the secondary coil 22. A permanent magnet 441 is located in the core gap 44. The permanent magnet 441 is in an ellipse shape, and extends along a gap defining surface. The gap defining surface includes the end surface 44A and the end surface 44B. The end surface 44A is located in a portion of the core center portion 41 of the first core member 4A on the one axial end side D1. The end surface 44B is located in a portion of the core center portion 41 of the second core member 4B on the other axial end side D2. The permanent magnet 441, which is located in the core gap 44, has both sides with respect to a second direction E2 of the closed magnetic path core 4, and each of the sides of the permanent magnet 441 is in a convex shape along the shape of the core center portion 41. The permanent magnet 441 has both sides with respect to the first direction E1 of the closed magnetic path core 4, and each of the sides of the permanent magnet 441 is also in a convex shape along the shape of the core center portion 41. The permanent magnet 441 is in the shape an ellipse planar plate.

In the present embodiment, the joint portion 45 is constructed by fitting the projected portion 451 to the recessed portion 452. The projected portion 451 is provided to one of the first core member 4A and the second core member 4B. The recessed portion 452 is provided to the other of the first core member 4A and the second core member 4B.

Figure 24:
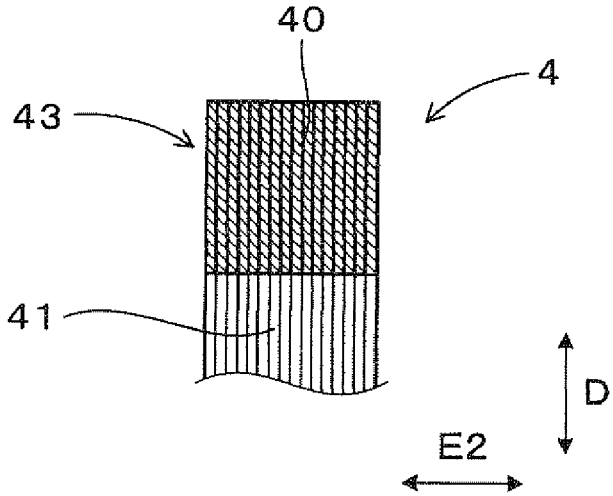
FIG. 24 is an axial sectional view taken along the line XXIV-XXIV in FIG. 22 and showing the core center portion of the closed magnetic path core according to the third embodiment.

As shown in FIG. 23, in the present embodiment, the multiple electromagnetic plates 40 are different from each other in width, so that the core outer portion 42 has a specific cross section. Specifically, the core outer portion 42 has an inner side 425 inside with respect to the first direction E1 and outer sides 426 outside with respect to the second direction E2, and each of the sides 425, 426 are substantially in a linear shape. The core outer portion 42 has an outer side 427 outside with respect to the first direction E1, and the side 427 is substantially in a convex shape. As shown in FIG. 24, the multiple electromagnetic plates 40 are the same as each other in width, so that each of the pair of core interconnecting portions 43 has a specific cross section substantially in a rectangular shape. Each of the electromagnetic plate 40 of each of the core members 4A, 4B includes a pair of parallel portions 401 and a pair of connecting portions 402. The pair of parallel portions 401 are arranged to be substantially in parallel with each other. Each of the pair of connecting portions 402 connects the pair of parallel portions 401 with each other. In the present embodiment, the multiple electromagnetic plates 40 are different from each other in width in the parallel portion 401, so that each of the core center portion 41 and the core outer portion 42 has the specific cross section.

Referring to FIGS. 19, 22, the two core members 4A, 48 excluding a particular surfaces are substantially entirely covered with a mold resin 46. Specifically, the mold resin 46 covers the two core members 4A, 4B excluding the end surfaces defining the two connecting portions 411, 421 and a part of an outer side 431 of the core interconnecting portion 43 outside with respect to the axial direction D. The end surfaces of the two core members 4A, 4B defining the two connecting portions 411, 421 also define all the end surfaces 44A, 44B, the projected portion 451, and the recessed portion 452. The mold resin 46 may be, for example, polypropylene resin. The multiple electromagnetic plates 40 are stacked each other and are fixed with each other by bonding or crimping to form the core members 4A, 4B. Thereafter, the core members 4A, 4B are molded with resin, whereby the mold resin 46 is formed. The surfaces of the electromagnetic plates 40 may be applied with an insulating material to form insulating layers. The electromagnetic plates 40 having the insulating layers may be stacked and crimped with each other, whereby the electromagnetic plates 40 can be electrically insulated from each other via the insulating layer. One of the core interconnecting portions 43 is located on the other axial end side D2 on the upper side in FIG. 22, and the one of the core interconnecting portions 43 has the outer side 431 outside with respect to the axial direction D. Referring to FIG. 19, the outer side 431 is provided with a stress relaxation member 47. The stress relaxation member 47 is formed of resin or rubber, and configured to mitigate stress exerted to both the core center portion 41 and the core outer portion 42 with respect to the axial direction D. In the present embodiment, the insulating resin 15 is also charged into gaps such as the gap between the mold resin 46 and the primary spool 211 and the gap between the mold resin 46 and the coil case 3.

Figure 26:
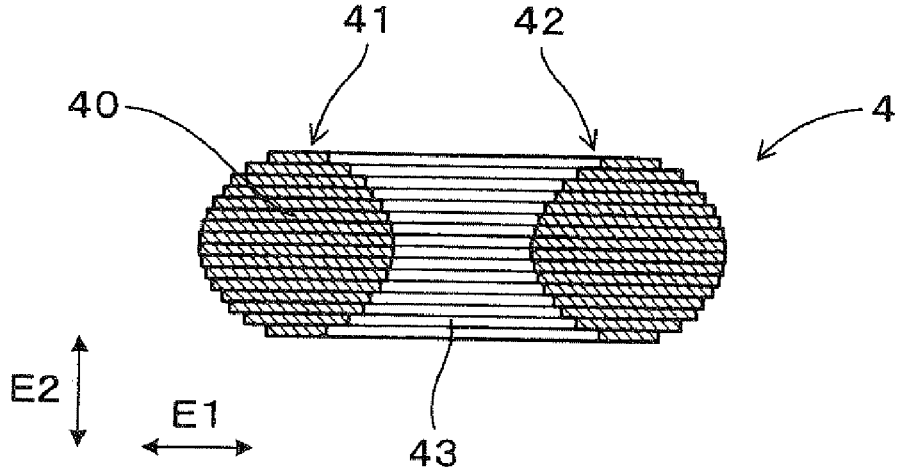
FIG. 26 is an axial sectional view showing a core center portion and a core outer portion of another closed magnetic path core according to the third embodiment.
Figure 27:
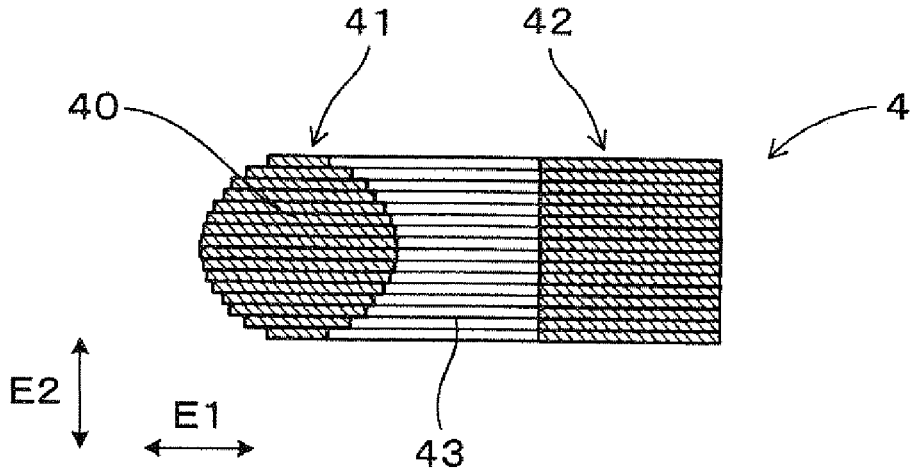
FIG. 27 is an axial sectional view showing a core center portion and a core outer portion of another closed magnetic path core according to the third embodiment.
Figure 28:
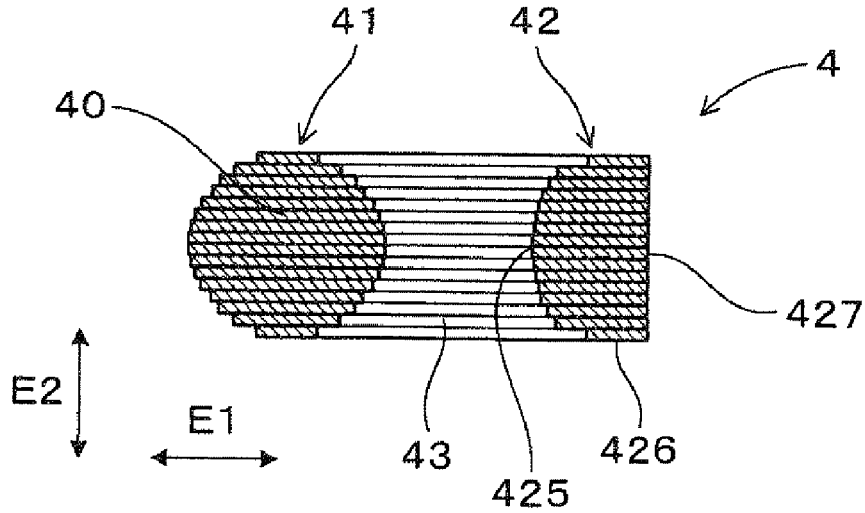
FIG. 28 is an axial sectional view showing a core center portion and a core outer portion of another closed magnetic path core according to the third embodiment.

As shown in FIG. 26, the multiple electromagnetic plates 40 may be different from each other in width such that the core outer portion 42 has a cross section substantially in a circular shape. As shown in FIG. 27, the multiple electromagnetic plates 40 may be substantially the same as each other in width such that the core outer portion 42 has a cross section substantially in a rectangular shape. As shown in FIG. 28, the multiple electromagnetic plates 40 are different from each other in width, and the core outer portion 42 may have a specific cross section. Specifically, the core outer portion 42 has an outer side 427 outside with respect to the first direction E1 and the outer sides 426 outside with respect to the second direction E2, and each of the sides 426, 427 may be substantially in a linear shape. The core outer portion 42 has the inner side 425 inside with respect to the first direction E1, and the inner side 425 may be substantially in a convex shape.

Figure 29:
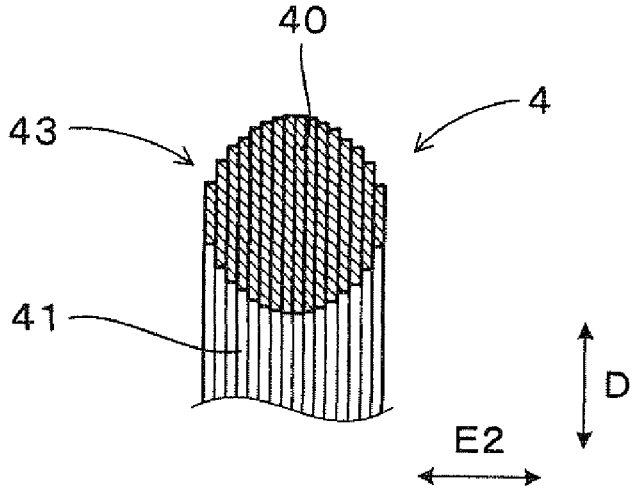
FIG. 29 is an axial sectional view showing a core interconnecting portion of the closed magnetic path core according to the third embodiment.
Figure 30:
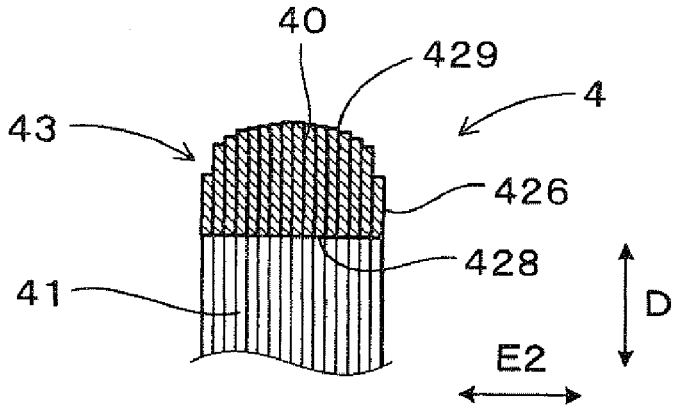
FIG. 30 is an axial sectional view showing a core interconnecting portion of another closed magnetic path core according to the third embodiment.
Figure 31:
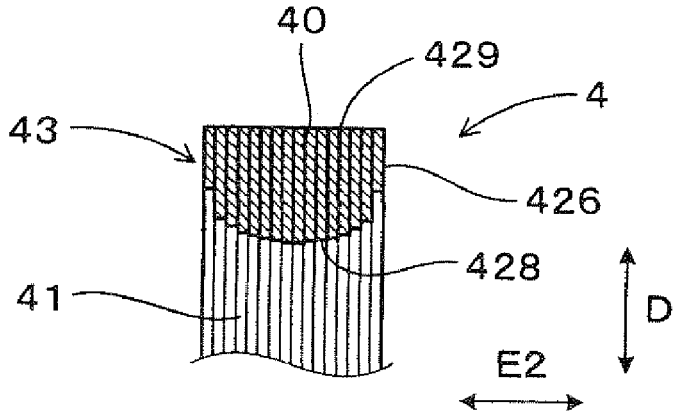
FIG. 31 is an axial sectional view showing a core interconnecting portion of another closed magnetic path core according to the third embodiment.

As shown in FIG. 29, the multiple electromagnetic plates 40 are different from each other in width, such that at least one of the core interconnecting portions 43 has a cross section substantially in a circular shape. As shown in FIG. 30, the multiple electromagnetic plates 40 are different from each other in width, and at least one of the core interconnecting portions 43 may have a specific cross section. Specifically, at least one of the core interconnecting portions 43 has an inner side 428 inside with respect to the axial direction D and the outer sides 426 outside with respect to the second direction E2, and each of the sides 426, 428 may be substantially in a linear shape. The at least one of the core interconnecting portions 43 has an outer side 429 outside with respect to the axial direction D, and the outer side 429 may be substantially in a convex shape. As shown in FIG. 31, at least one of the core interconnecting portions 43 has the outer side 429 outside with respect to the axial direction D and the outer sides 426 outside with respect to the second direction E2, and each of the sides 426, 429 may be substantially in a linear shape. The at least one of the core interconnecting portions 43 has an inner side 428 inside with respect to the axial direction D, and the inner side 428 may be substantially in a convex shape.

In a structure where the outer side 429 outside with respect to the axial direction D is substantially in a convex shape, heat stress exerted to the insulating resin 15 such as epoxy resin can be mitigated around the outer side 429. Thus, the insulating resin 15 can be restricted from causing a crack around the outer side 429. In a structure where the inner side 428 inside with respect to the axial direction D is substantially in a convex shape, heat stress exerted to the insulating resin 15 such as epoxy resin can be mitigated around the inner side 428. Thus, the insulating resin 15 can be protected from causing a crack around the inner side 428.

Referring to FIG. 20, the coil case 3 has the outer circumferential periphery provided with the flange portion 31, which projects radially outward. The cylinder head cover 92 is attached to the cylinder head 91, and the flange portion 31 is fixed to the cylinder head cover 92 with the bolt 312 as the fixing member. The connector portion 35 projects radially outward from the outer circumferential periphery of the end of the coil case 3 on the other axial end side D2. The connector portion 35 is provided with the conduction pin for conducting electricity to each winding end of the primary coil 21. The harness is pulled out from the connector portion 35. The primary coil 21 is connected with the igniter device via the harness. The igniter device is provided outside the ignition coil 1. As shown in FIG. 25, the igniter device 19 includes the switching control circuit, which controls supplying of electricity to the primary coil 21 and termination of the electricity in response to the signal transmitted from the electronic control unit (ECU).

Referring to FIG. 20, the cable drawing portion 32 is projected radially outward from the outer circumferential periphery of the end of the coil case 3 on the other axial end side D2. The conducting cable 34 is drawn from the cable drawing portion 32. The end of the high-voltage winding of the second secondary coil 22B on the other axial end side D2 is electrically connected with the conducting cable 34 via the drawing metal fitting provided to the cable drawing portion 32. The coil portion 11, i.e., the coil case 3 has the clearance therein, and the primary coil 21, the secondary coil 22, the closed magnetic path core 4, and the like are located in the clearance. The tower portion 5 and the coil case 3 therebetween define the gap, and the gap is filled with the thermosetting insulating resin 15 such as epoxy resin.

In the present embodiment, the ignition coil 1 is capable of generating a spark between the electrodes in each of the two sparkplugs 8A, 8B. When the switching control circuit 19 supplies electricity to the primary coil 21 in response to an instruction transmitted from the ECU, the closed magnetic path core 4 generates a magnetic field to pass therethrough. Subsequently, when the electricity supply to the primary coil 21 is terminated, the primary coil 21 therein causes voltage by self-induction, and the two secondary coils 22 therein cause high-voltage induced electromotive force by mutual induction. Thus, a spark can be generated between the electrodes of the first sparkplug 8A, which is electrically connected with the first secondary coil 22A. Another spark can be also generated between the electrodes of the second sparkplug 8B, which is electrically connected with the second secondary coil 22B.

The ignition coil 1 includes the closed magnetic path core 4 being in the shape of the square annulus and having the core center portion 41, the core outer portion 42, and the pair of core interconnecting portions 43. The multiple electromagnetic plates 40 are stacked to construct the closed magnetic path core 4. In the present embodiment, the core center portion 41 has a specific shape. Specifically, the closed magnetic path core 4 in the shape of the square annulus is formed by connecting the two core members 4A, 4B each being formed by stacking the electromagnetic plates 40. The connecting portions 411, 421 define the core gap 44 and the joint portion 45. The electromagnetic plates 40 are different from each other in width, whereby the core center portion 41 is substantially in the circular shape in cross section.

In the present structure, the core center portion 41 of the closed magnetic path core 4 can be arranged by efficiently using the space on the radially inner side of both the primary coil 21 and the secondary coil 22 being wound to be substantially in a circle-shape in cross section. In addition, the two core members 4A, 4B of the closed magnetic path core 4 are constructed of the first core member 4A and the second core member 4B each being in the shape described above. In the present structure, the core gap 44 can be easily defined in the one connecting portion 411 such that the core gap 44 is inclined with respect to the axial direction D of both the primary coil 21 and the secondary coil 22. In the present structure, a sufficient area can be easily secured in the core gap 44. Therefore, according to the ignition coil 1 in the present embodiment, both the primary coil 21 and the secondary coil 22 can be restricted from being large in diameter in the structure where the closed magnetic path core 4 is substantially in the square annulus shape, and the cross-sectional area of the closed magnetic path core 4 can be easily sufficiently secured.

The above ignition coil is not limited to be applied to a dual ignition system (two-point ignition system). The above ignition coil may be applied to any other multipoint ignition systems such as a four-point ignition system and a six-point ignition system.

The above structures of the embodiments can be combined as appropriate.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. An ignition coil configured to be equipped with a first sparkplug of an engine, the ignition coil comprising:

a coil portion including a coil case accommodating a primary coil and a secondary coil, which are coaxial with each other and have a coil axis; and a plug mount portion including a tower portion, which is formed from resin, and a plug cap, which is formed of rubber, wherein the tower portion includes a coupled portion connected with an end of the coil portion, the tower portion further includes a tower cylinder portion projected from the coupled portion and equipped with the plug cap, the plug cap is configured to be press-fitted with the first sparkplug, the coil case has an outer periphery from which a flange portion projects radially outward in a flange-projecting direction, the tower cylinder portion has a tower axis, which is substantially in parallel with the coil axis, the tower axis is offset from the coil axis in a tower-offset direction, the tower-offset direction is substantially the same as the flange-projecting direction, wherein the flange portion is configured to be fixed to a cylinder head cover, which is attached to a cylinder head of the engine, by using a fixing member, when the plug mount portion is located in a first plughole of a cylinder head of the engine and equipped with the first sparkplug, the coil portion is located completely outside of the first plughole, the coil case has one axial end side, an intermediate portion, and an other axial end side in this order in a longitudinal direction of the coil case, and the flange portion projects from the intermediate portion.

2. The ignition coil according to claim 1, wherein the plug mount portion further includes a metal fitting and a coil spring, the metal fitting is electrically connected with the secondary coil, and the coil spring is configured to electrically conduct the metal fitting with the first sparkplug.

3. The ignition coil according to claim 2, wherein the plug cap has a press-fit opening configured to be press-fitted with an insulator portion of the first sparkplug, and the press-fit opening has a plug axis that substantially coincides with the tower axis.

4. The ignition coil according to claim 2, wherein the plug cap is inclined with respect to the tower cylinder portion, the plug cap has a press-fit opening configured to be press-fitted with an insulator portion of the first sparkplug, and the press-fit opening has a plug axis that is inclined with respect to the coil axis in a substantially opposite direction to the flange-projecting direction.

5. The ignition coil according to claim 2, wherein the tower portion is a component separate from the coil case of the coil portion, the coupled portion has a fitted portion projected from the coupled portion, and the coupled portion is connected with the coil case by fitting the fitted portion to the coil case.

6. The ignition coil according to claim 2, wherein the secondary coil is wound around an outer circumferential periphery of an secondary spool, which is formed from resin to be substantially in a ring shape in cross section, the metal fitting includes a spool side metal fitting provided to the outer circumferential periphery of the secondary spool on the one axial end side, the spool side metal fitting being electrically connected with the secondary coil, the metal fitting further includes a tower side metal fitting provided to the coupled portion, the tower side metal fitting electrically connecting the spool side metal fitting with the coil spring, the spool side metal fitting is offset from the coil axis in a fitting-offset direction, which is substantially the same as a plug-offset direction in which the plug axis is offset from the coil axis, the tower side metal fitting includes a spring contact portion being in contact with the coil spring, the tower side metal fitting further includes a connecting terminal portion provided to an outer circumferential periphery of the secondary spool on the one axial end side, and the connecting terminal portion electrically connects the spool side metal fitting with the spring contact portion.

7. The ignition coil according to claim 3, wherein the plug cap includes a cap body having an outer circumferential periphery being substantially in an annular shape in cross section, the plug cap further includes a plurality of latch projections being located radially outside of the cap body at circumferential locations, the plurality of latch projections being configured to be latched in the first plughole, wherein the plug axis is offset from the coil axis such that the outer circumferential periphery of the cap body is located at:

a position inside an outer circumferential periphery of the coil case; or a position substantially the same as a position of an outer circumferential periphery of the coil case.

8. The ignition coil according to claim 2 configured to be provided in a multiple ignition system, in which mixture gas is to be ignited at a plurality of locations in a cylinder of the engine, wherein the secondary coil includes a first secondary coil and a second secondary coil, the first secondary coil is located on an outer periphery of a secondary spool on the one axial end side, the secondary spool being formed from resin to be in a ring-shaped in cross section, the first secondary coil is constructed by winding a secondary electric wire, which is applied with an electrically insulative coating, from the one axial end side toward the other axial end side in a first winding direction, the second secondary coil is located on an outer periphery of the secondary spool on the other axial end side, the second secondary coil is constructed by winding a secondary electric wire, which extends from one end of the first secondary coil, the secondary electric wire is wound from the one axial end side toward the other axial end side in a second winding direction being opposite to the first winding direction, the first secondary coil is configured to be electrically connected with the first sparkplug attached to the first plughole, the second secondary coil is electrically connected with a second sparkplug attached to a second plughole of the cylinder of the engine, and the intermediate portion is located between the first secondary coil and the second secondary coil.

9. The ignition coil according to claim 2, wherein the coil case accommodates a closed magnetic path core substantially in an annulus shape and configured to conduct magnetic flux, which is generated when the primary coil is energized, through a path radially inside and outside of both the primary and secondary coils and both axial end sides of the primary and secondary coils, the closed magnetic path core includes:

a core center portion located radially inside of both the primary and secondary coils;

a core outer portion located radially outside of both the primary and secondary coils;

a first core interconnecting portion connecting one axial ends of the core outer portion and the core center portion; and a second core interconnecting portion connecting other axial ends of the core outer portion and the core center portion, wherein the flange-projecting direction is different from a core-arrangement direction in which the core outer portion is located with respect to the core center portion.

10. The ignition coil according to claim 2, wherein the fixing member is a bolt having a fixing axis, the coil axis and the fixing axis therebetween define a first imaginary line when being viewed perpendicularly to the coil axis, the coil axis and the tower axis therebetween define a second imaginary line when being viewed perpendicularly to the coil axis, and the second imaginary line is at an angle with respect to the first imaginary line, the angle being in a range between +45 degrees and −45 degrees.

11. The ignition coil according to claim 10, wherein the second imaginary line substantially coincides with the first imaginary line.

12. The ignition coil according to claim 1, further comprising:

a connector portion provided to the other axial end of the coil case, wherein the flange portion is distant from the connector portion in the longitudinal direction.

13. The ignition coil according to claim 12, wherein the connector portion and the coil case overlap one another in a radial direction of the coil case.

14. The ignition coil according to claim 13, wherein the intermediate portion is located in a substantially center portion of the coil case in the longitudinal direction.

15. The ignition coil according to claim 14, wherein the coil case is at least partially out of the cylinder head cover when the plug mount portion is located in the first plughole and equipped with the first sparkplug.

16. An ignition coil configured to be provided to a multiple ignition system, in which mixture gas is to be ignited at a plurality of locations in a cylinder of the engine, the ignition coil configured to be equipped with a first sparkplug attached to a first plughole of a cylinder head of the engine and a second sparkplug attached to a second plughole of the cylinder head, the ignition coil comprising:

a coil portion including a coil case accommodating a primary coil and a secondary coil, which are coaxial with each other and have a coil axis; and a plug mount portion including a tower portion, which is formed from resin, and a plug cap, which is formed of rubber, wherein the tower portion includes a coupled portion connected with an end of the coil portion, the tower portion further includes a tower cylinder portion projected from the coupled portion and equipped with the plug cap, the plug cap is configured to be press-fitted with the first sparkplug, the coil case has an outer periphery from which a flange portion projects radially outward in a flange-projecting direction, the tower cylinder portion has a tower axis, which is substantially in parallel with the coil axis, the tower axis is offset from the coil axis in a tower-offset direction, the tower-offset direction is substantially the same as the flange-projecting direction, the flange portion is configured to be fixed to a cylinder head cover, which is attached to the cylinder head of the engine, by using a fixing member, when the plug mount portion is located in the first plughole and equipped with the first sparkplug, the coil portion is located completely outside of the first plughole, the coil case has one axial end side, an intermediate portion, and an other axial end side in the order recited in a longitudinal direction of the coil case, the secondary coil includes a first secondary coil and a second secondary coil, the first secondary coil is located on an outer periphery of a secondary spool, which is formed from resin to be in a ring-shaped in cross section, on the one axial end side and constructed by winding a secondary electric wire from the one axial end side toward the other axial end side in a first winding direction, the second secondary coil is located on an outer periphery of the secondary spool on the other axial end side and constructed by winding a secondary electric wire, which extends from one end of the first secondary coil, from the one axial end side toward the other axial end side in a second winding direction being opposite to the first winding direction, the first secondary coil is configured to be electrically connected with the first sparkplug, the second secondary coil is configured to be electrically connected with the second sparkplug attached to the second plughole, and the flange portion projects from the intermediate portion located between the first secondary coil and the second secondary coil.

17. The ignition coil according to claim 16, further comprising:

a connector portion provided to the other axial end of the coil case, wherein the flange portion is distant from the connector portion in the longitudinal direction.

18. The ignition coil according to claim 17, wherein the connector portion and the coil case overlap one another in a radial direction of the coil case.

19. The ignition coil according to claim 18, wherein the intermediate portion is located in a substantially center portion of the coil case in the longitudinal direction.

20. The ignition coil according to claim 19, wherein the coil case is at least partially out of the cylinder head cover when the plug mount portion is located in the first plughole and equipped with the first sparkplug.

* * * * *